US007056159B2

(12) United States Patent
Fukatsu et al.

(10) Patent No.: US 7,056,159 B2
(45) Date of Patent: Jun. 6, 2006

(54) CONNECTOR

(75) Inventors: Yukihiro Fukatsu, Yokkaichi (JP); Toshikazu Sakurai, Yokkaichi (JP); Satoshi Suda, Wako (JP); Yoshiaki Kida, Wako (JP); Masaru Shinmura, Wako (JP)

(73) Assignees: Sumitomo Wiring Systems, Ltd. (JP); Honda Motor Co., Ltd. (JP)

( * ) Notice: Subject to any disclaimer, the term of this patent is extended or adjusted under 35 U.S.C. 154(b) by 0 days.

(21) Appl. No.: 10/866,208

(22) Filed: Jun. 10, 2004

(65) Prior Publication Data

US 2005/0101196 A1 May 12, 2005

(30) Foreign Application Priority Data

Nov. 6, 2003 (JP) ..... 2003-166788
Nov. 6, 2003 (JP) ..... 2003-166915
Nov. 6, 2003 (JP) ..... 2003-166995

(51) Int. Cl.
*H01R 13/436* (2006.01)

(52) U.S. Cl. ..... 439/752

(58) Field of Classification Search ..... 439/752, 439/595

See application file for complete search history.

(56) References Cited

U.S. PATENT DOCUMENTS 5,509,829 A * 4/1996 Saba ..... 439/752
5,865,653 A 2/1999 Okada et al.
6,083,042 A * 7/2000 Kodama ..... 439/567
6,176,713 B1 * 1/2001 Okabe ..... 439/157
6,497,591 B1 * 12/2002 Fujita ..... 439/752
6,599,154 B1 * 7/2003 Sakurai et al. ..... 439/752

* cited by examiner

*Primary Examiner*—Alexander Gilman
(74) *Attorney, Agent, or Firm*—Gerald E. Hespos; Anthony J. Casella

(57) ABSTRACT

A male housing (20) is provided with cavities (23) for inserting male terminal metal pieces (10) in two upper and lower stages and a retainer mounting hole (27) opening the respective cavities (23) in a lower direction and in two side directions. The retainer (40) is mounted movably and skewedly to a direction of inserting and drawing the male terminal metal piece (10) between a full locking position permitting to insert and draw the male terminal metal piece (10) and a regular locking position locked to the male terminal metal piece (10).

6 Claims, 31 Drawing Sheets

51
51a
42
52
47
49
50
48
41a
44p
46
45 (41b)
46
53
40
45 (41c)
41
47
32
32a
30
31
21
34
30a
27
29
33
33a
38
20

CONNECTOR

BACKGROUND OF THE INVENTION

1. Field of the Invention

The present invention relates to a connector having a retainer.

2. Description of the Related Art

In a prior art, there is known an example of a connector having a retainer moving skewedly to a direction of inserting a terminal metal piece as described in U.S. Pat. No. 5,865,653. According to the example, the retainer is mounted to a retainer mounting hole provided to open at an outer face of a housing, and the retainer is made to be able to move between a partial locking position at which a drawout preventing portion thereof is escaped from a cavity to permit to insert and draw the terminal metal piece and a full locking position at which the drawout preventing portion invades inside of the cavity to be locked by the terminal metal piece skewedly to a direction of inserting and drawing the terminal metal piece.

However, a direction of moving the above-described retainer is skewed to the direction of inserting and drawing the terminal metal piece and therefore, at the partial locking position at which the retainer is moved back, a predetermined gap is opened between a front edge of the retainer and a front edge of the retainer mounting hole and there is a concern of penetrating of an outside foreign object therefrom to inside of the cavity.

In the above-described connector, when it is requested to carry out so-called inner-die assembly in which, for example, the housing and the retainer are molded by a resin in the same die and when the die is opened, the retainer is mounted to the housing at the partial locking position at inside of the die, it is necessary to mold the retainer mounting hole by a sliding die from a direction orthogonal to a direction of mounting the retainer and therefore, the retainer mounting hole is opened in three directions of the mounting direction and two side directions orthogonal to the mounting direction. Furthermore, when the terminal metal pieces inserted into the cavities at two upper and lower stages is intended to prevent from being drawn out by the single retainer, the retainer mounting hole opens the respective cavities in the side directions and therefore, there is a possibility of posing the following problem.

That is, since the direction of moving the retainer is skewed to the direction of inserting and drawing the terminal metal piece, at the moved-back partial locking position, a predetermined gap is opened between a front edge of the retainer and a front edge of the retainer mounting hole. Further, the gap is opened also in the side directions similar to the retainer mounting hole and therefore, the terminal metal pieces inserted into the upper and lower cavities are exposed to outside via the gap and there is a concern of being shortcircuited by an outside foreign object.

In the above-described connector, when it is requested to carry out so-called inner-die assembly in which, for example, the housing and the retainer are molded by a resin in the same die and when the die is opened, the retainer is mounted to the housing at the partial locking position at inside of the die, it is necessary to mold a retainer mounting hole by a sliding die from a direction orthogonal to a direction of mounting the retainer. Therefore, the retainer mounting hole is opened in three directions from a face thereof in the housing opposed to the mounting direction over to a pair of faces along the mounting direction contiguous to each other. Further, the retainer mounting hole is formed up to a depth for opening an inserting path at a rear end of a main body portion in three directions for convenience of making the drawout preventing portion advance to the inserting path of the rear end of the main body portion.

However, when the retainer mounting hole is constituted by a mode of opening in three directions as described above, there is a concern of posing the following problem. That is, when there is brought about a situation in which, for example, the retainer disposed at the full locking position is erroneously returned to a side of the partial locking position, or the retainer is detached from the housing, a region of the inserting path of the rear end of the main body portion on a rear side of a front edge of the retainer mounting hole is opened in three directions. At this occasion, when the terminal metal piece is pulled to a rear side, a terminal metal piece is moved back within a range of a clearance formed between the terminal metal piece and a lance, and at this occasion, there is a concern that the rear end of the main body portion reaches the region on the rear side of the front edge of the retainer mounting hole. When an outside foreign object invades the retainer mounting hole to reach the inserting path of the rear end of the main body portion under the state, the foreign object is brought into contact with the rear end of the main body portion and there is a possibility of short-circuiting the terminal metal pieces contiguous to each other in a width direction.

Therefore, one object of the invention is to prevent a foreign object from penetrating a cavity.

It is another object of the invention to prevent a terminal metal piece from being short-circuited.

SUMMARY OF THE INVENTION

According to a first aspect of the invention, there is provided a connector including: a connector housing; a cavity provided in the connector housing and capable of inserting a terminal metal piece from a rear side; and a retainer mounting hole formed on the connector housing and opens the cavity to an outer side at a partial locking position of the cavity, the retainer mounting hole capable of mounting a retainer, wherein the retainer is mounted movably and skewedly to a direction of inserting and drawing the terminal metal piece between a partial locking position permitting to insert and draw the terminal metal piece and a full locking position of locking to the terminal metal piece and a gap is opened between a front edge of the retainer and a front edge of the retainer mounting hole at the partial locking position; and wherein at least either one of the retainer and the connector housing is provided with a restricting portion that restricts a foreign object from penetrating the cavity by being projected to a side of the gap.

According to a second aspect of the invention, there is provided a connector including: a connector housing; a plurality of cavities provided in the connector housing to be aligned in a height direction and capable of inserting terminal metal pieces from a rear side; and a retainer mounting hole formed on the connector housing and opens the respective cavities to outer sides at partial locking positions of the cavities, the retainer mounting hole capable of mounting a retainer which is notched to form to open in three directions along a face opposed to a direction of pressing the retainer over to a pair of side faces along the height direction contiguous thereto, wherein the retainer is mounted movably and skewedly to a direction of inserting and drawing the terminal metal pieces between a partial locking position permitting to insert and draw the terminal metal pieces and a full locking position locked to the terminal metal pieces, and at the partial locking position, a gap is opened between a front edge of the retainer and a front edge of the retainer mounting hole; and wherein whereas a projected portion projected to a side of the gap is provided at at least either one of the retainer and the connector housing, a recess portion for escaping the projected portion when a retainer is moved to the full locking position is formed at an opposed side thereof to thereby arrange portions of the gap in correspondence with the terminal metal pieces in the respective cavities having different heights to be positionally shifted from each other in a front and rear direction.

According to a third aspect of the invention, there is provided a connector including: a connector housing; a cavity provided in the connector housing and capable of inserting from a rear side a terminal metal piece having a main body portion having substantially a box-like shape; and a retainer mounting hole formed on the connector housing and opens the cavity to an outer side at a partial locking position of the cavity and capable of mounting a retainer, wherein whereas inside of the cavity is provided with a lance capable of being locked by the terminal metal piece inserted to a regular depth, the retainer is provided with a drawout preventing portion locked by a rear end of the main body portion when the retainer is mounted to a regular mounting position and is made to be movable skewedly to a direction of inserting and drawing the terminal metal piece when the retainer reaches the regular mounting position to thereby enable to press the rear end of the main body portion of the terminal metal piece which is deficient in a depth of being inserted into the cavity by the drawout preventing portion to correct to a regular depth, wherein the retainer mounting hole is notched to form open in three directions from a face thereof opposed to a direction of mounting the retainer in the connector housing over to a pair of faces thereof contiguous thereto and along the direction of mounting the retainer and formed to a depth of opening an inserting path at a rear end of the main body portion to the three direction, and wherein the drawout preventing portion is provided with a pressing projected portion capable of pressing the rear end of the main body portion to a position projected frontward from a front edge of the retainer mounting hole in the cavity by moving to the position when the retainer is mounted to the regular mounting position.

BRIEF DESCRIPTION OF THE DRAWINGS

The objects and advantages of the present invention will become more apparent by describing preferred embodiments thereof in detail with reference to the accompanying drawings, wherein.

DETAILED DESCRIPTION OF THE PREFERRED EMBODIMENTS

Referring now to the accompanying drawings, a description will be given in detail of preferred embodiments of the invention.

A first embodiment of the invention will be explained in reference to FIG. 1 through FIG. 15B. According to the first embodiment, a male side connector is exemplified. The connector is generally constituted by a mail connector housing 20 (hereinafter, simply referred to as the male housing 20), a male terminal metal piece 10 contained at inside of the mail housing 20, and a retainer 40 mounted to the mail housing 20. Further, in the following, a direction of inserting the male terminal metal piece 10 to the mail housing 20 is made to constitute a front direction and a direction of drawing the male terminal metal piece 10 therefrom inverse thereto is made to constitute a rear direction. Further, a reference of an up and down direction is constituted by respective drawings except FIG. 3, FIG. 6, FIG. 10, FIG. 14 and FIG. 15.

Figure 8:
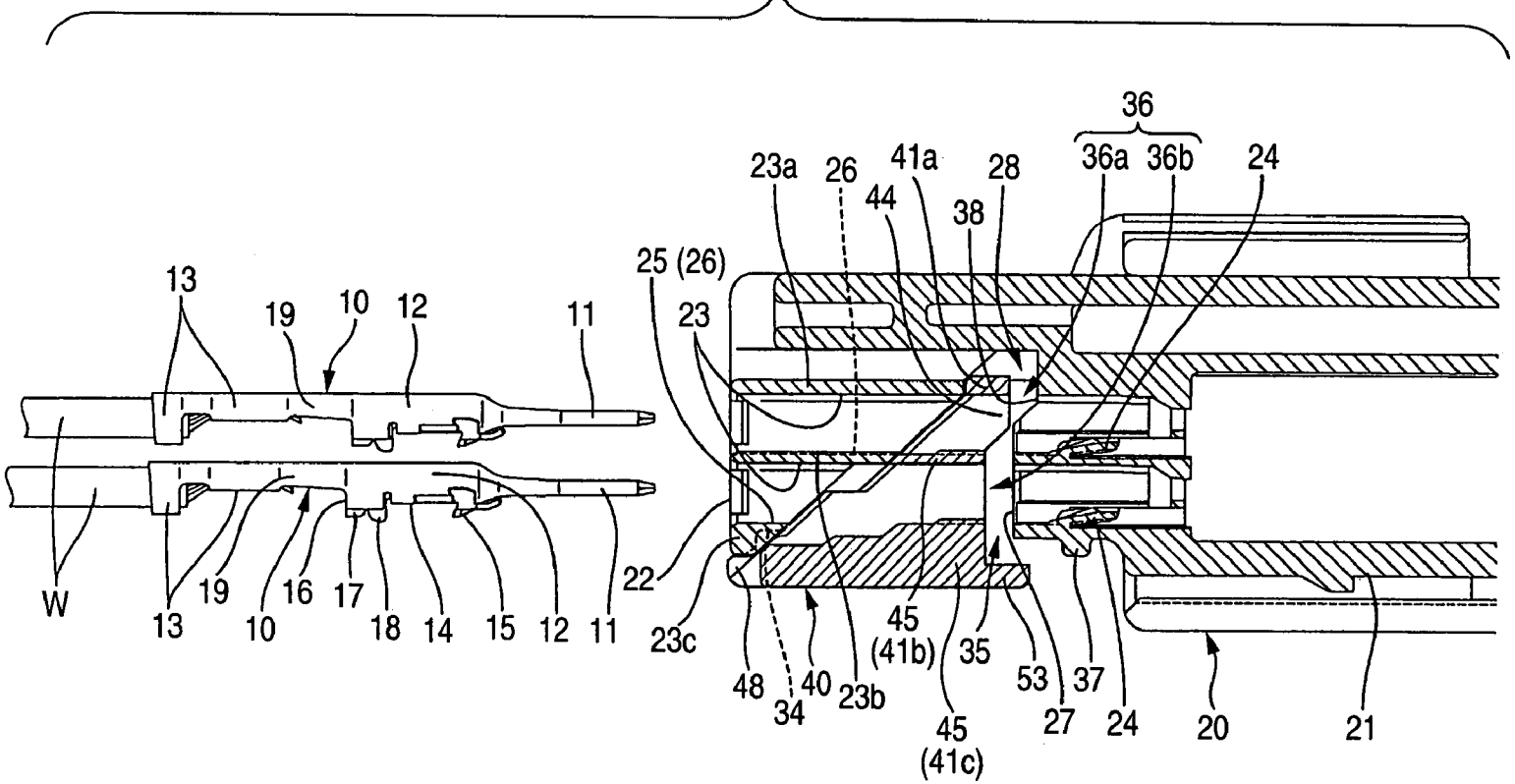
FIG. 8 is a side sectional view of the male housing mounted with a male terminal metal piece and the retainer at a partial locking position.

First, the male terminal metal piece 10 will be explained. The male terminal metal piece 10 is formed by bending a metal plate punched into a predetermined development shape and is constituted by a tab portion 11 capable of being connected to contact to a counter female metal piece (not illustrated), a main body portion 12 constituting substantially a box-like shape, and a barrel portion 13 connected to be brought into press contact with a terminal of an electric wire W successively from a front side as shown in FIG. 8. The tab portion 11 is formed by bending a slender plate piece extended from a front edge of the main body portion 12 to be brought into close contact along a length direction thereof. The barrel portion 13 is provided with pairs of calking pieces opposedly at front and rear sides thereof, whereas the two calking pieces on the front side are calked to a core line of the electric wire W, the two calking pieces on the rear side are calked to a cover of the electric wire W. The barrel portion 13 is connected to the main body portion 12 by a connecting portion 19.

Substantially at a center in a length direction of a lower face of the main body portion 12 (outer face opposed to a lance 24) a recess portion 14 for permitting advancement of the lance 24 is formed and an upper portion of the lance 24 is locked by a front edge thereof. At the front edge of the recess portion 14, a locking projecting portion 15 for locking a lower portion of the lance 24 is struck out to form to project to a lower side. A stepped difference portion formed at a rear end portion of a lower face of the main body portion 12 is made to constitute a locking stepped portion 16 for locking the retainer. At the locked stepped portion 16, a projected portion 17 projected to a height substantially the same as that of the locking projected portion 15 and capable of locking the retainer 40 is struck out to form. At a position immediate frontward from the projected portion 17, a stabilizer 18 projected further to a lower side of the projected portion 17 is formed and the stabilizer 18 functions to stabilize operation of inserting the male terminal metal piece 10 and prevent inverse insertion thereof.

Next, the male housing 20 will be explained. The male housing 20 is made of a synthetic resin and is constituted to connect a hood portion 21 capable of fitting the counter female connector from a front side and a terminal containing portion 22 capable of containing the male terminal metal piece 10 as shown in FIG. 8. The hood portion 21 is formed substantially in a shape of a square cylinder opened to the front side and an upper face side of an inner peripheral face thereof is provided with a locking portion (not illustrated) capable of holding the female connector in a fitted state by locking a lock arm provided at the female connector.

Figure 2:
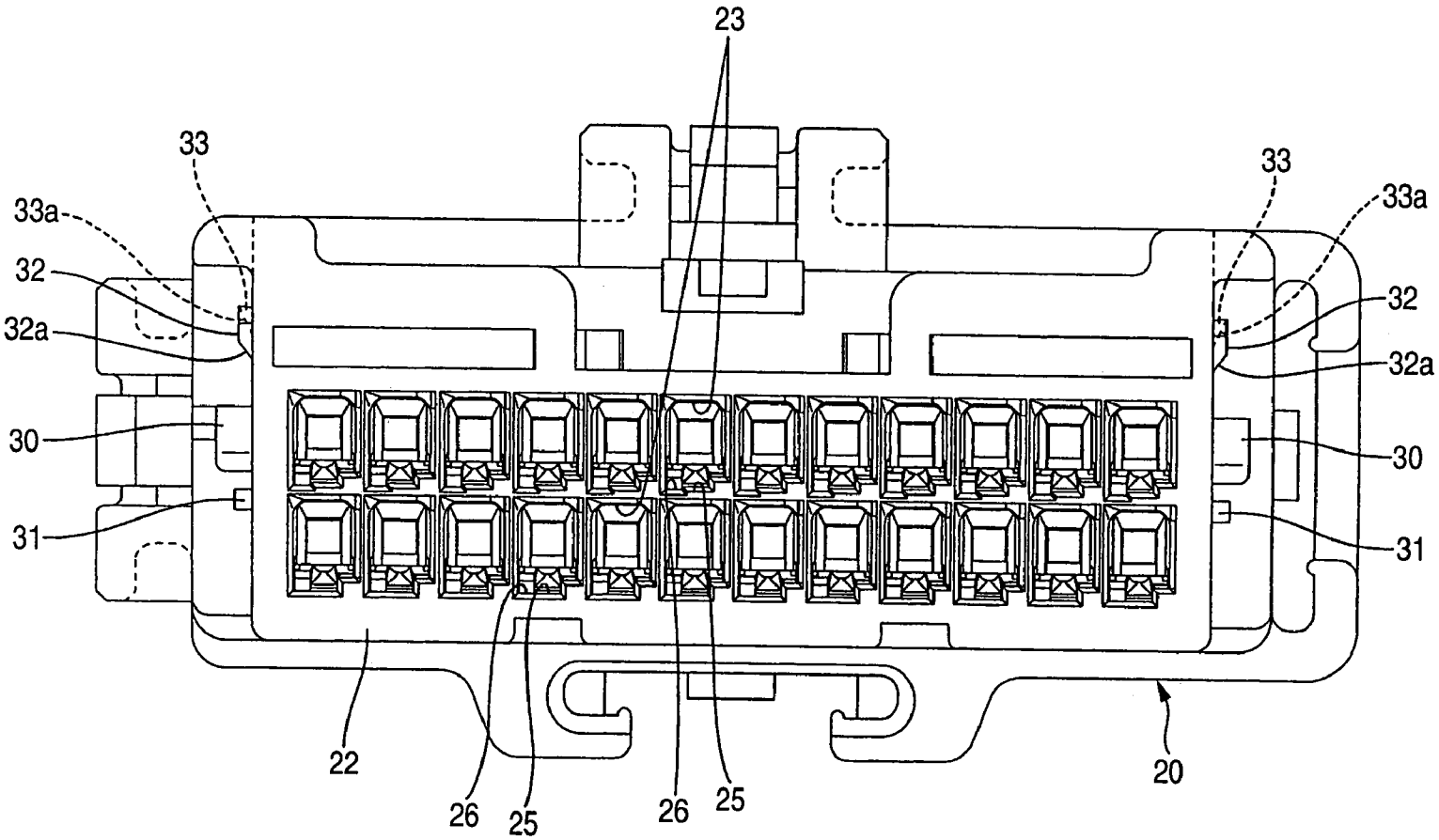
FIG. 2 is a rear view of a male housing.
Figure 3:
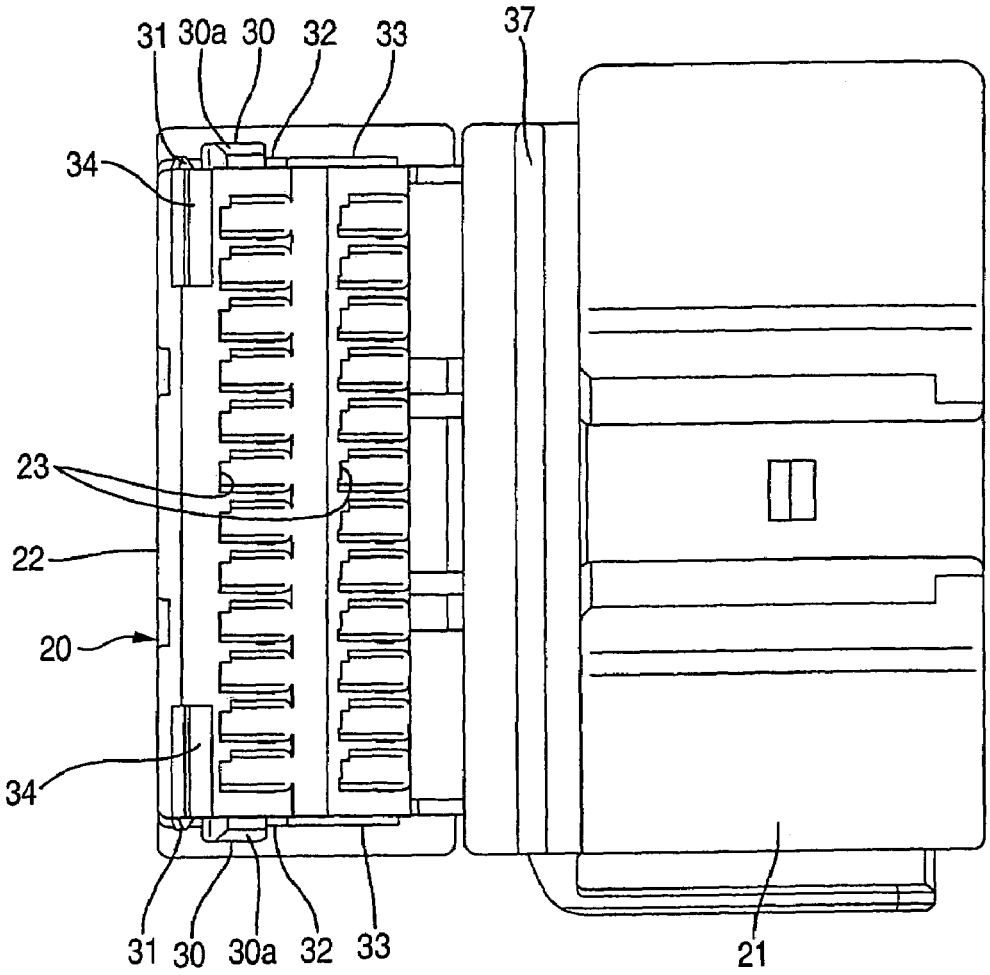
FIG. 3 is a bottom view of the male housing.

As shown in FIG. 2 and FIG. 8, the terminal containing portion 22 is formed substantially in a block-like shape prolonged in a width direction thereof, inside thereof is provided with cavities 23 capable of inserting the male terminal metal pieces 10 from the rear side and the cavities 23 are formed to penetrate the male housing 20 in the front and rear direction and arranged in two upper and lower stages to align in the width direction by a plurality of chambers thereof. A lower face of each cavity 23 is provided with the lance 24 capable of elastically locking the male terminal metal piece 10. The lance 24 is formed to extend to the front side in a cantilever shape and is made to be able to deform to bend in an up and down direction (direction intersecting with a direction of inserting and drawing the male terminal metal piece 10). Further, a projected portion inserting groove 25 capable of inserting the locking projected portion 15 and the projected portion 17 is formed to recess over an entire length thereof at substantially a center in a width direction of the lower face of the cavity 23 and a stabilizer inserting groove 26 capable of inserting the stabilizer 18 is formed to recess at a left side edge (one corner portion) thereof in FIG. 2. The projected portion inserting groove 25 is formed over an entire length of the above-described lance 24 to thereby reduce an amount of bending the lance 24 in inserting the male terminal metal piece 10. Further, the stabilizer inserting groove 26 reaches up to a position slightly rearward from a base end portion of the lance 24 and is opened only to the rear side. Further, whereas on the upper stage side, the stabilizer inserting groove 26 is formed to be deeper than the projected portion inserting groove 25, on the lower stage side, the projected portion inserting groove 25 is set to a depth substantially the same as that of the stabilizer inserting groove 26.

An outer peripheral face of the terminal containing portion 22 is opened with a retainer mounting hole 27 for mounting the retainer 40. The retainer mounting hole 27 is formed over a three faces region of a lower face (face opposed to a direction of pressing the retainer 40) and two side faces along the direction of pressing the retainer 40) in the male housing 20 and therefore, the retainer mounting hole 27 is constituted by a mode of opening in the three directions. The retainer mounting hole 27 is formed by a depth reaching a position upward from an upper wall 23*a* of the cavity 23 at the upper stage and divides peripheral walls of the upper and lower respective cavities 23 in the front and rear direction to thereby open the respective cavities 23 to outer sides thereof at midways thereof. A portion of the retainer mounting hole 27 upward from the upper walls 23*a* of the cavities 23 at the upper stage is formed not to open to sides but open to the rear side to thereby constitute an escaping space 28 for an upper portion 41*a* of a retainer main body portion 41, mentioned later.

Although a front edge of hole edges of the retainer mounting hole 27 is formed substantially straightly along the up and down direction up to a depth of about a half of a side wall of the cavity 23 at the upper stage (partitioning wall of the cavity 23 in the width direction), the front edge cuts an upper half portion of the side wall while being inclined to constitute an upward slope to the front side therefrom and thereafter is formed straightly in the up and down direction again to cut the upper wall 23*a* of the cavity 23 at the upper stage and a portion upward therefrom. Therefore, an upper portion of a front edge of the retainer mounting hole 27 is formed with a recess portion 38 recessed to the front side more than a lower portion thereof. In contrast thereto, although a rear edge of the retainer mounting hole 27 is formed to be inclined to constitute an upward slope to the front side up to a lower wall 23*b* of the cavity 23 at the upper stage (upper wall of the cavity 23 at the lower stage, wall partitioning the upper and lower cavities 23), the rear edge is formed substantially horizontally by an amount of a predetermined length therefrom and thereafter cuts the lower wall 23*b* and the side wall of the cavity 23 at the upper stage while being inclined again and thereafter, formed straightly along the up and down direction to cut the upper wall 23*a* of the cavity 23 at the upper stage and thereafter, is inclined again by an amount of a predetermined height and formed substantially horizontally. Further, all of inclined angles at portions of inclining the hole edges of the retainer mounting hole 27 are set to about 40 degrees (less than 45 degrees) relative to the direction of inserting the male terminal metal piece 10. Further, a portion of a lower wall 23*c* of the cavity 23 at the lower stage on a rear side of the retainer mounting hole 27 is formed to be thicker than a front side portion and is formed to constitute a height substantially the same as that of the retainer 40 constituting a full locking position.

Figure 1:
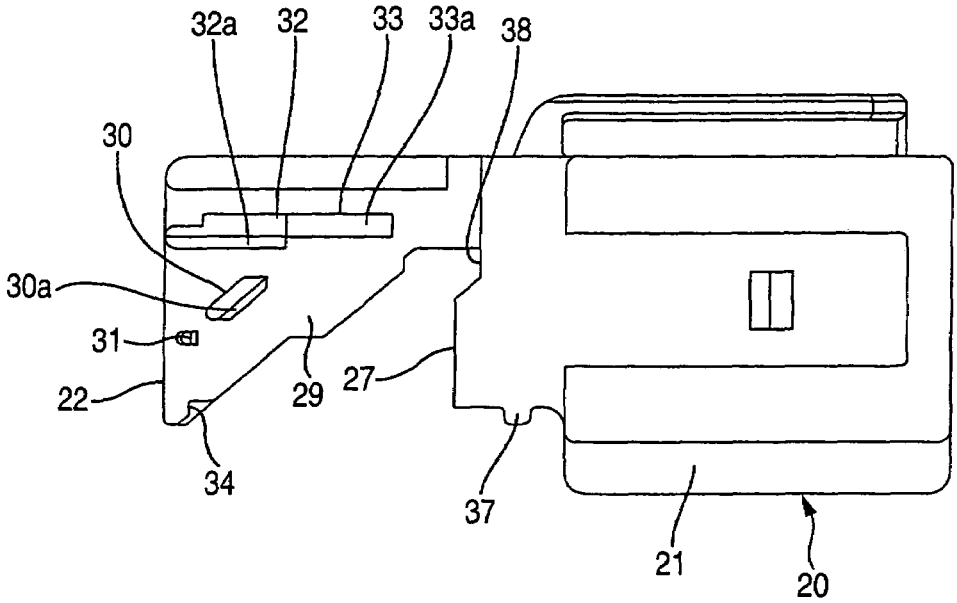
FIG. 1 is a side view of a male housing according to a first embodiment of the invention.
Figure 7:
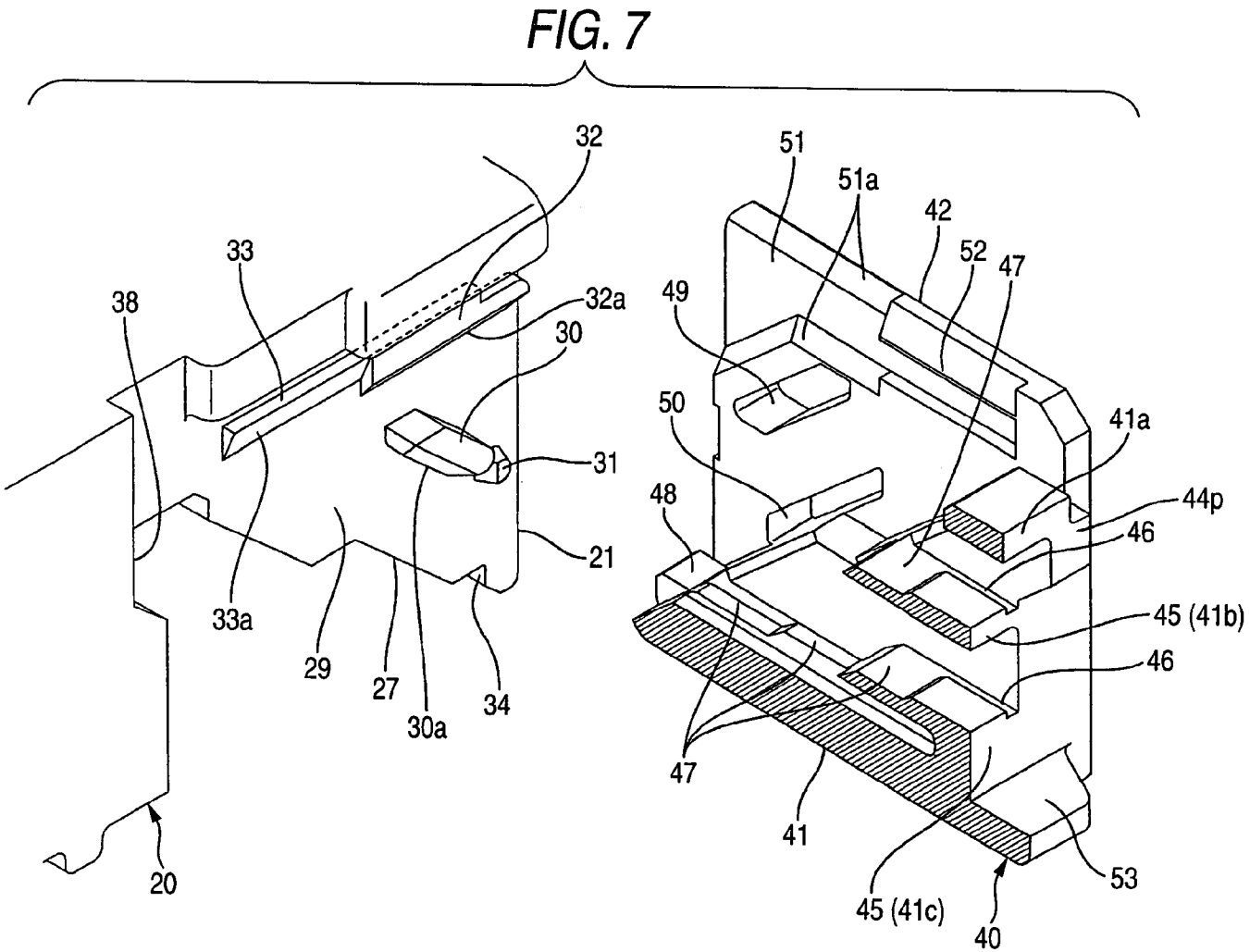
FIG. 7 is a perspective view showing respective peripheral portions of a locking projection and a guide groove.

As shown in FIGS. 1 and 7, in two side faces of the terminal containing portion 22, regions of upper sides and rear sides of the side face opening portions of the retainer mounting hole 27 constitute stepped difference faces 29 and is further recessed more than front regions. The stepped difference face 29 is provided with a locking projection 30 in a rib-like shape along an inclination of the rear edge of the retainer mounting hole 27. The locking projection 30 mainly serves to stabilize a pressing attitude when the retainer 40 is pressed to mount to the male housing 20. Further, at an outer face of the locking projection 30, one side of a boundary of a center line in a length direction thereof (lower side, side proximate to the retainer mounting hole 27) is provided with a facing 30*a* over an entire face thereof, thereby, operation of fitting the retainer 40 to a guide groove 49 is made to be able to carry out smoothly. Further, two upper and lower end faces of the locking projection 30 are respectively formed with horizontal faces and the end face on the upper side is also formed with a vertical face continuous to the horizontal face.

Further, a press restricting projection 31 is formed to project on a lower extended line of the locking projection 30. The press restricting projection 31 is arranged to separate from the locking projection 30 by a predetermined distance and when the retainer 40 is disposed at a tackedly locking portion (position shown in FIG. 8 through FIG. 10), the press restricting projection 31 restricts pressing by being locked by a lower end of the guide groove 49 of the retainer 40 such that the retainer 40 is not erroneously pressed to the full locking position so far as the press restricting projection 31 is not exerted with an operating force equal to or larger than a predetermined force.

A jouncing restricting portion 32 for restraining jouncing when the retainer 40 is disposed at the full locking position (position shown in FIG. 12 through FIG. 14) is projected on an upper side of the above-described locking projection 30 in the stepped difference face 29. The jouncing restricting portion 32 is constituted by a mode of being extended substantially horizontally along the front and rear direction. Meanwhile, a taper face 32*a* constituting an upward slope toward the upper side is formed on a side of a lower face of the jouncing restricting portion 32 over an entire length thereof. Further, a catching piece 33 is projected to form on a front side of the jouncing restricting portion 32. The catching piece 33 is formed such that an upper edge thereof is continuously to an upper edge of the jouncing restricting portion 32 and can hold the retainer 40 at the full locking position by being locked by a locking claw 52 of the retainer 40 when the retainer 40 is disposed at the full locking position. Incidentally, a lower face side of the catching piece 33 is formed with a taper face 33*a* constituting an upward slope to the upper side to thereby make operation of making the locking claw 52 ride thereover smoothly. Further, in the rear edge of the retainer mounting hole 27, lower end portions of both ends in the width direction are provided with locking recess portions 34 capable of holding the retainer 40 in a state of being restricted from being displaced from the full locking position to the rear side by being locked by a locking portion 48 of the retainer 40. A rear face of the locking recess portion 34 for being locked by the locking portion 48 is constituted by a face rising straightly along the up and down direction.

Figure 4:
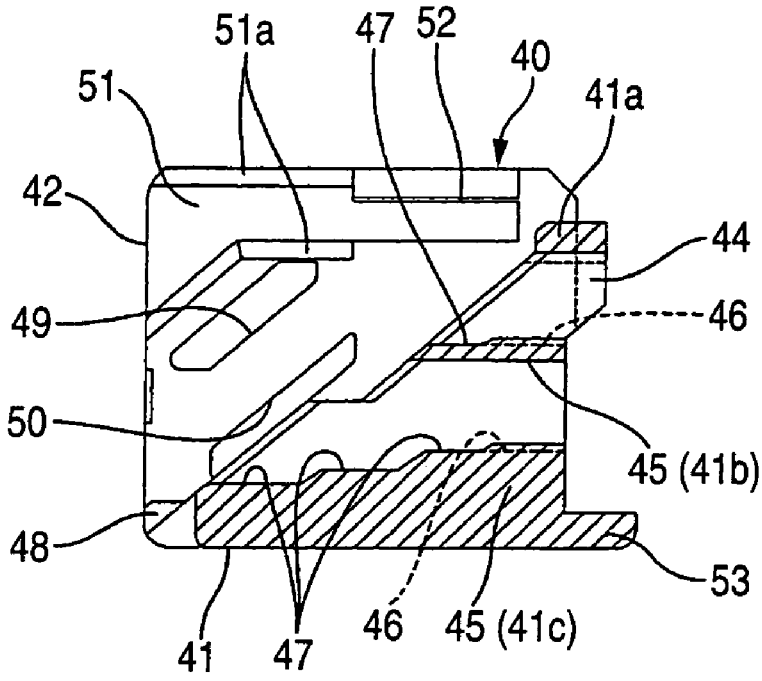
FIG. 4 is a side sectional view a retainer.

Successively, the retainer 40 will be explained. The retainer 40 is formed by a synthetic resin material similar to the female housing 20 and as shown in FIG. 4, is constituted by the retainer main body portion 41 adapted to fit to the retainer mounting hole 27 and a pair of side plates 42 projected to form at both end portions in a width direction of the retainer main body portion 41. The retainer 40 is made to be movable skewedly to the direction of inserting and drawing the male terminal metal piece 10 between the partial locking position and the full locking position, mentioned later. Further, thick-walled operating portions 43 are provided at rear portions of the both side plates 42.

Figure 5:
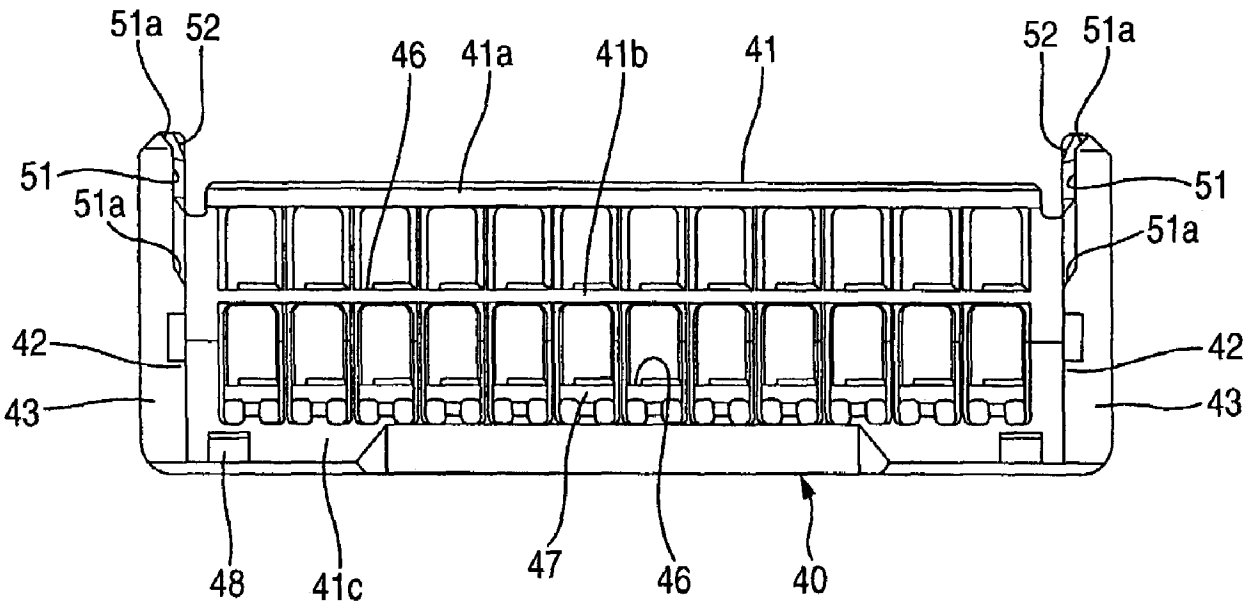
FIG. 5 is a rear view of the retainer.
Figure 6:
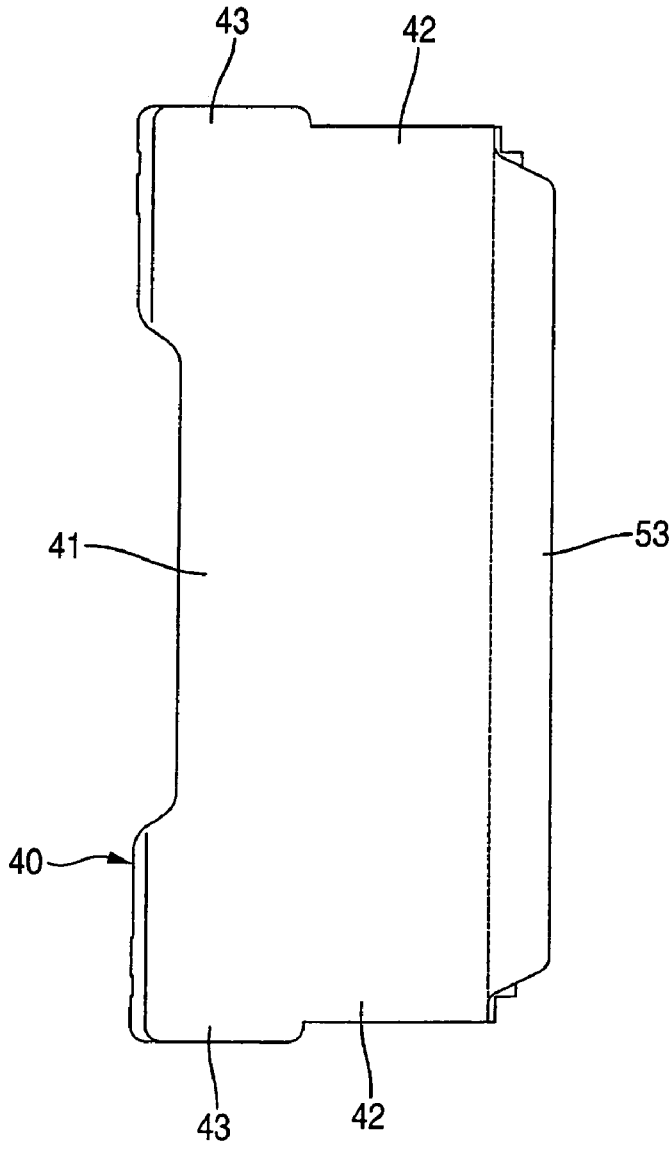
FIG. 6 is a bottom view of the retainer.

As shown in FIG. 4 and FIG. 5, the retainer main body portion 41 is formed in a shape of a lattice having two upper and lower stages adjustable (connectable) to the upper and lower respective cavities 23 of the male housing 20, in details, constituted such that an upper portion 41*a*, a middle portion 41*b* and a lower portion 41*c* extended along the width direction are connected by respective side portions respectively extended along the up and down direction. A front edge and a rear edge of the retainer main body portion 41 are formed in a shape substantially adjusted to the front edge and the rear edge of the hole edges of the retainer mounting hole 27, mentioned above. In details, a front edge of the retainer main body portion 41 is formed to rise straightly along the up and down direction from the lower portion 41*c* to the middle portion 41*b*, substantially a lower half of a side portion on the side of the upper stage is formed to incline to constitute an upward slope to the front side, and substantially an upper half of the side portion and the upper portion 41*a* are formed straightly in the up and down direction. The side portion at the upper stage side and a portion of the upper portion 41*a* projected to the front side are made to constitute a projected portion 44. In contrast thereto, according to a rear edge of the retainer main body portion 41, upper and lower portions interposing a horizontal portion having a predetermined length formed substantially a center of a side portion of the lower stage are formed in an inclined shape constituting an upward slope to the front side, and the upper portion 41*a* is formed straightly along the up and down direction and thereafter formed in an inclined shape. Further, an upper face of the upper portion 41*a* is formed substantially horizontally.

When the retainer 40 is disposed at the partial locking position, the retainer main body 41 formed substantially in a shape of a lattice communicates with the respective cavities 23, in details, in the retainer main body portion 41, the upper portion 41*a* is substantially adjusted to the upper wall 23*a* of the cavity 23 at the upper stage, the middle portion 41*b* is substantially adjusted to the lower wall 23*b* of the cavity 23 at the upper stage and the lower portion 41*c* is substantially adjusted to the lower wall 23*c* of the cavity 23 at the lower stage, respectively and the retainer main body portion 41 is arranged to escape from the respective cavities 13 to thereby permit to insert and draw the male terminal metal pieces 10 (FIG. 8). At the partial locking position, the upper portion 41*a* of the retainer main body portion 41 is made to be able to be locked by the male terminal metal piece 10 inserted into the cavity 23 on the upper stage side and the middle portion 41*b* is made to be able to be locked by the male terminal metal piece 10 inserted into the cavity 23 at the lower stage side, respectively, to thereby enable to restrict the retainer 40 from being positionally shifted from the partial locking position to the lower side in the state of inserting the male terminal metal pieces 10. That is, the upper portion 41*a* and the middle portion 41*b* of the retainer main body portion 41 can be regarded to constitute drawout restricting portions capable of restricting the retainer 40 from being detached.

Meanwhile, when the retainer 40 is disposed at the full locking position, the middle portion 41*b* of the retainer main body portion 41 is moved into the cavity 23 on the upper stage side, the lower portion 41*c* is moved into the cavity 23 on the lower stage side, respectively, and made to be lockable by the locking stepped portions 16 and the projected portions 17 of the male terminal metal pieces 10 (FIG. 12) to thereby constitute drawout preventing portions 45 relative to the male terminal metal pieces 10. The drawout preventing portion 45 is formed with the stabilizer passing groove 46 adjustable to the stabilizer inserting groove 26 of the cavity 23 at the partial locking position. Further, a side of a rear portion of the drawout preventing portion 45 is pertinently formed with an escaping recess portion 47 for escaping a projected portion (the barrel portion 13 or the like) of the male terminal metal piece 10, the electric wire W or the like. Further, lower end portions of rear faces at both end positions in the width direction of the lower portion 41*c* are provided with the pair of locking portions 48 having a section substantially in a triangular shape for locking the locking recess portions 34 when the retainer 40 reaches the full locking position. Further, at the full locking position, in the retainer main body portion 41, the projected portion 44 is made to escape into the recess portion 38 and the upper portion 41*a* is made to escape into the escaping space 28, respectively.

The both side plates 42 of the retainer 40 are arranged by an interval capable of riding over to interpose the two side faces of the male housing 20 and can be deformed to expand. Further, the both side plates 42 are formed by a size closing the opening portions of the side faces of the retainer mounting hole 27 when the retainer 40 is disposed at the full locking position and capable of being opposed to a predetermined range of the stepped difference face 29. Further, the both side plates 42 are formed by a thickness substantially the same as a depth of the stepped difference face 29 and when the retainer 40 is disposed at the full locking position, a face thereof is substantially flush with an outer side face of the male housing 20. Thereby, the both side plates 42 of the retainer 40 serve also as outer walls of the side face portions of the male housing 20.

Figure 9:
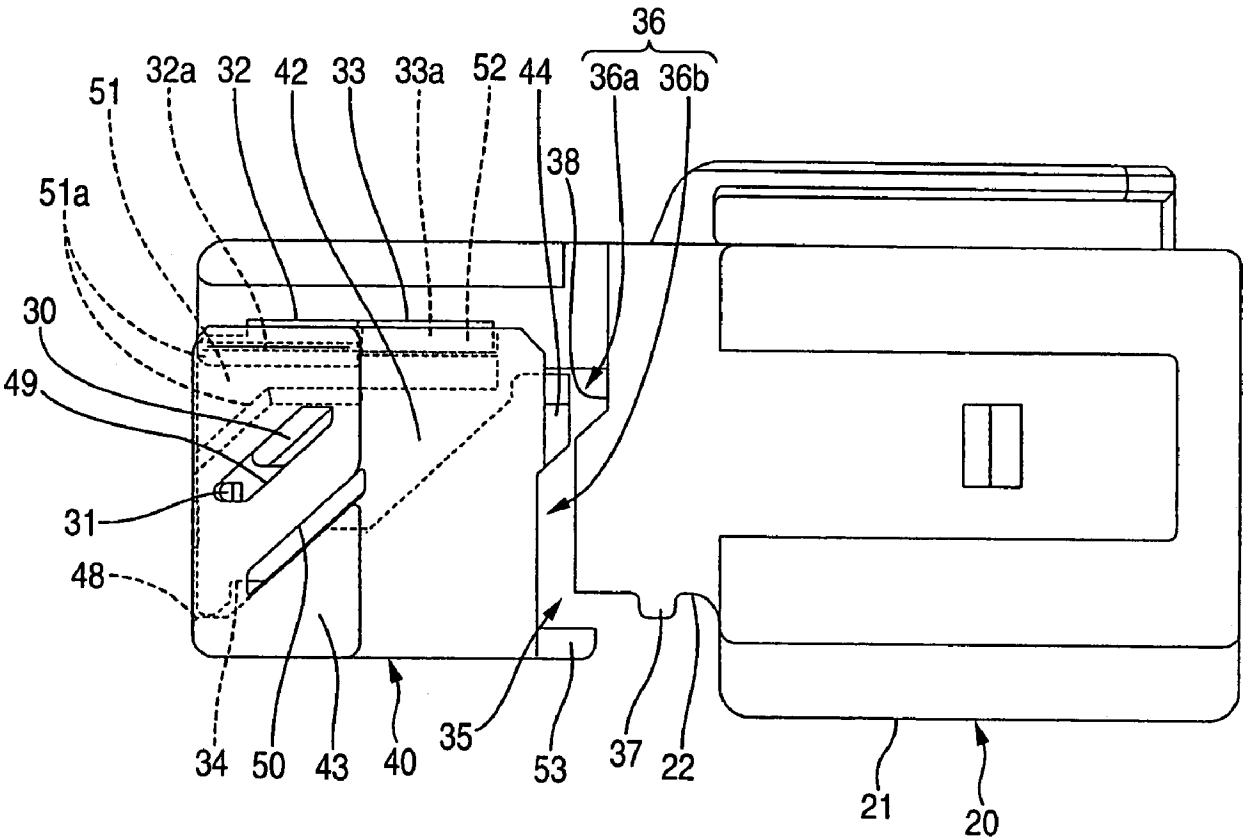
FIG. 9 is a side view of the male housing mounted with the retainer at the partial locking position.
Figure 10:
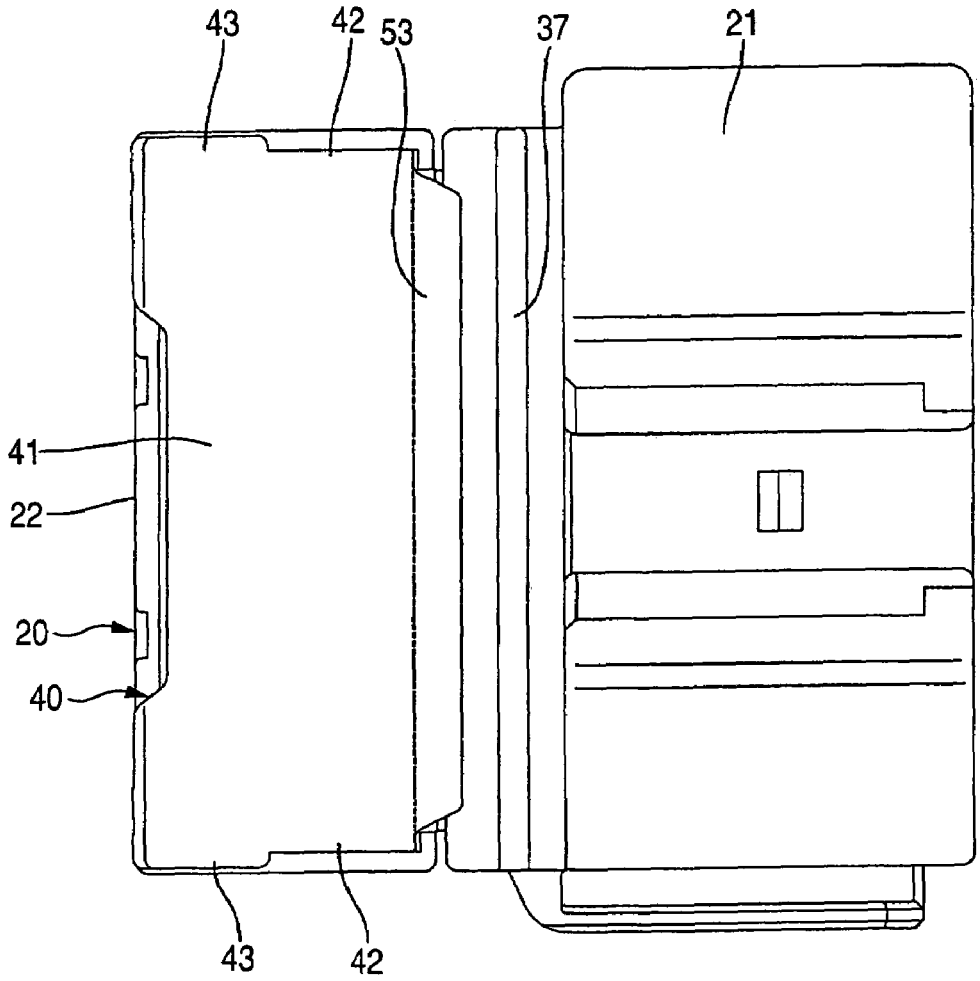
FIG. 10 is a bottom view of the male housing mounted with the retainer at the partial locking position.
Figure 13:
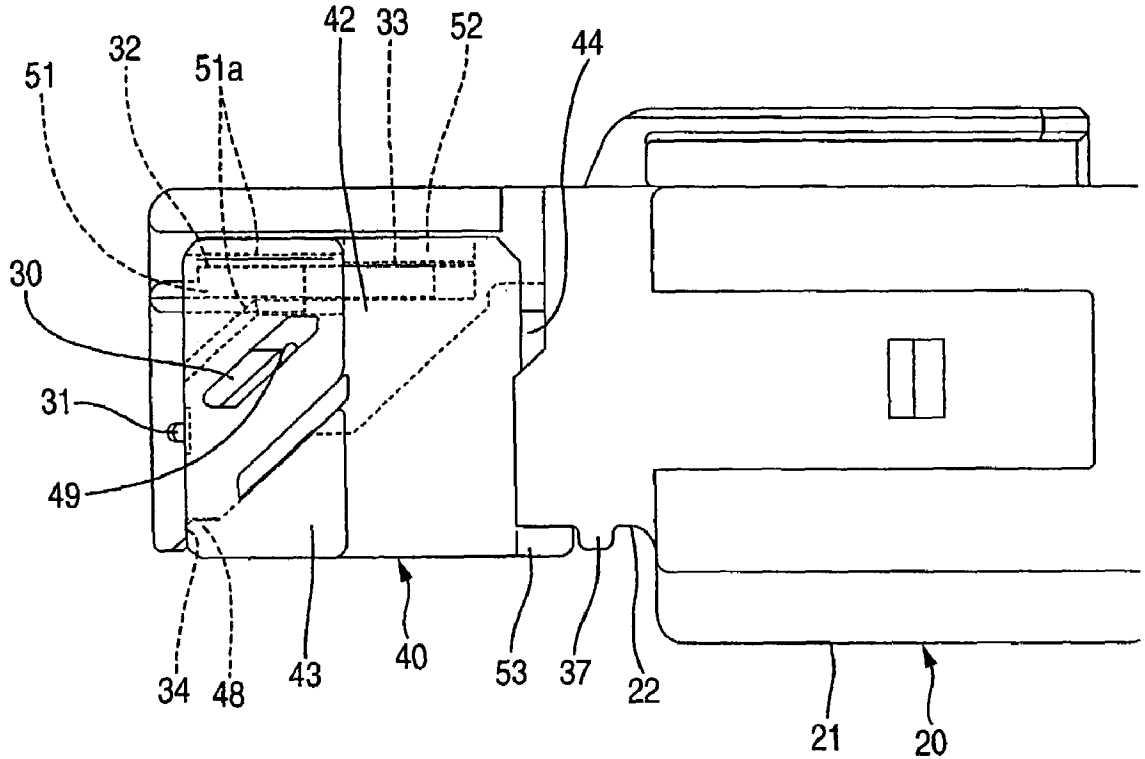
FIG. 13 is a sectional view showing the state of arranging the retainer at the full locking position.

As shown in FIG. 4, the guide groove 49 is formed to penetrate at a position on a rear side of the retainer main body 41 in each of the both side plates 42. The guide groove 49 is formed by a slope along an inclination of the rear edge of the retainer main body portion 41, that is, by a slope substantially the same as an inclination (a direction of moving the retainer 40) at the rear edge of the retainer mounting hole 27. Further, the guide groove 49 is formed by a groove width substantially the same as a width dimension of a short side of the locking projection 30 and both end portions thereof are formed to adjust to shapes of both end portions of the locking projection 30. Further, the guide groove 49 can lock the locking-projection 30 and the press restricting projection 31 by two front and rear ends thereof to thereby hold the retainer 40 at the partial locking position (FIG. 9). Further, when the retainer 40 is moved from the partial locking position to the full locking positions, the press restricting projection 31 is made to ride over to escape from the guide groove 49, during the time period, the both side plates 42 are deformed to expand, and an amount of projecting the locking projection 30 is larger than that of the press restricting projection 31 and a locking margin having a height sufficient for continuing a state of being locked by the guide groove 49 even by deforming to expand the side plates 42. Thereby, by moving the locking projection 30 to a lower end side of the guide groove 49, the retainer 40 is brought into the regular locking state (FIG. 13). Further, a wall lightening portion 50 having an inclination substantially the same as the guide groove 49 is formed to penetrate at a position downward from the guide groove 49 in each of the both side plates 42. A groove width of the wall lightening portion 50 is set to be smaller than that of the guide groove 49 and the both side plates 42 are made to be easy to deform to expand by pertinently reducing rigidity of the both side plates 42 thereby.

Further, on an upper side of the guide groove 49 at an inner face of each of the both side plates 42, a restricting recess portion 51 capable of fitting the above-described jouncing restricting portion 32 is formed to recess and taper faces 51*a* are formed at two upper and lower edges thereof. The restricting recess portion 51 is formed over a range reaching a rear end from substantially a central portion of each of the both side plates 42 in a length direction thereof and is opened to the rear side. The restricting recess portion 51 is opened to the upper side in a height direction thereof, a lower edge thereof is formed along a shape of an upper edge of the guide groove 49, in details, whereas a front portion thereof is formed substantially horizontally along the front and rear direction, a rear portion thereof is formed in an inclined shape constituting a downward slope to the rear side. Further, when the retainer 40 is disposed at the partial locking position, an upper edge of the jouncing restricting portion 32 is held at a height position substantially aligning with an upper edge of the restricting recess portion 51 and a predetermined gap is held between a lower edge thereof and a lower edge of the restricting recess portion 51 (FIG. 9). Further, when the retainer 40 is disposed at the full locking position, the taper face 32*a* of the lower edge of the jouncing restricting portion 32 is brought into contact to adjust to the taper face 51*a* formed at the lower edge of the restricting recess portion 51 to thereby enable to restrict jouncing to the upper side (FIG. 13).

Further, the restricting recess portion 51 is extended further to the front side to expand a recess region thereof and the locking claw 52 is formed at an upper edge portion thereof. When the retainer 40 is disposed at the partial locking position, the locking claw 52 is brought into a relationship of facing the catching piece 33 on the side of the male housing 20 substantially at the same height position, however, when the retainer 40 is shifted to a regular locking state, the locking claw 52 rides over the taper face 33*a* of the catching piece 33 to be locked by the upper edge of the locking piece 33 to thereby enable to hold the retainer 40 at the full locking position.

Meanwhile, a direction of moving the retainer 40 is directed in a direction skewed to the direction of inserting and drawing the male terminal metal piece 10 and therefore, at the partial locking position moved back from the full locking position, as shown in FIG. 8, a gap 35 opened downwardly and a gap 36 opened to both sides are formed between the front edge of the retainer 40 and the front edge of the retainer mounting hole 27.

Further, the retainer 40 is provided with a restricting portion 53 capable of restricting an outside foreign object from penetrating into the cavity 23 by being projected to a side of the gap 35 opened to the lower side. The restricting portion 53 is provided to project to the front side from a front face of a lower end portion of the lower portion 41*c* of the retainer main body 41 and a projected dimension thereof is set to be larger than a length of the gap 35 in the front and rear direction. A width dimension of the restricting portion 53 is set to be substantially the same as that of the retainer main body portion 41 (smaller than that of the terminal containing portion 22 of the male housing 20) and both side portions thereof in the width direction are formed with taper faces by cutting corner portions. The restricting portion 53 is made to be able to cover the gap 35 opened to the lower side along the width direction and is arranged to open a predetermined interval (amount of a height of moving the retainer 40) from a lower face of the terminal containing portion 22. Further, with regard to the gap 36 opened to the sides, since the front edge of the retainer mounting hole 27 and the upper portion of the front edge of the retainer 40 formed substantially in parallel with each other are constituted by a mode of projecting to the front side from lower portions thereof, an upper side portion 36*a* (region in correspondence with an upper half of the cavity 23 at the upper stage and a lower side portion 36*b* (region in correspondence with an entire region of the cavity 23 at the lower stage and a lower half of the cavity 23 at the upper stage) are positionally shifted in the front and rear direction. In other words, the gap 36 is divided into the upper side portion 36*a* and the lower side portion 36*b* by the projected portion 44 of the retainer main body portion 41 and the both members are arranged to positionally shift in the front and rear direction.

Whereas the front edge of the retainer 40 is provided with the projected portion 44 projected to the side of the gap 36 opened to the sides, the front edge of the retainer mounting hole 27 opposed to the projected portion 44 and the direction of pressing the retainer 40 (skewed front direction) are formed to recess the recess portion 38 for escaping the projected portion 44 when the retainer 40 is moved to the full locking position. Therefore, the gap 36 opened to the sides is arranged with an upper side portion 36*a* formed between the projected portion 44 and the recess portion 38 and a lower side portion 36*b* to positionally shift from each other in the front and rear direction.

In details, the projected portion 44 is formed in a range of from a position slightly upward from the upper wall 23*a* of the cavity 23 at the upper stage to a position of a lower end of the cavity 23 at the upper stage at the partial locking position, and a lower face thereof is constituted by an inclined face constituting an upward slope to the front side up to substantially a central position of the cavity 23 at the upper stage. The recess portion 38 is formed in a range of from a substantially central position of the cavity 23 at the upper stage to a further upper position of the upper wall 23*a* and a lower face thereof is constituted by an inclined face constituting substantially a shape of a straight line along with the inclined face of the projected portion 44. A length of projecting the projected portion 44 to the front side is set to be slightly smaller than a distance of moving the retainer 40 to the front side when the retainer 40 is moved from the partial locking position to the full locking position and therefore, at the partial locking position, the projected portion 44 is arranged on a slightly front side (in rear direction) of the recess portion 38.

Figure 11:
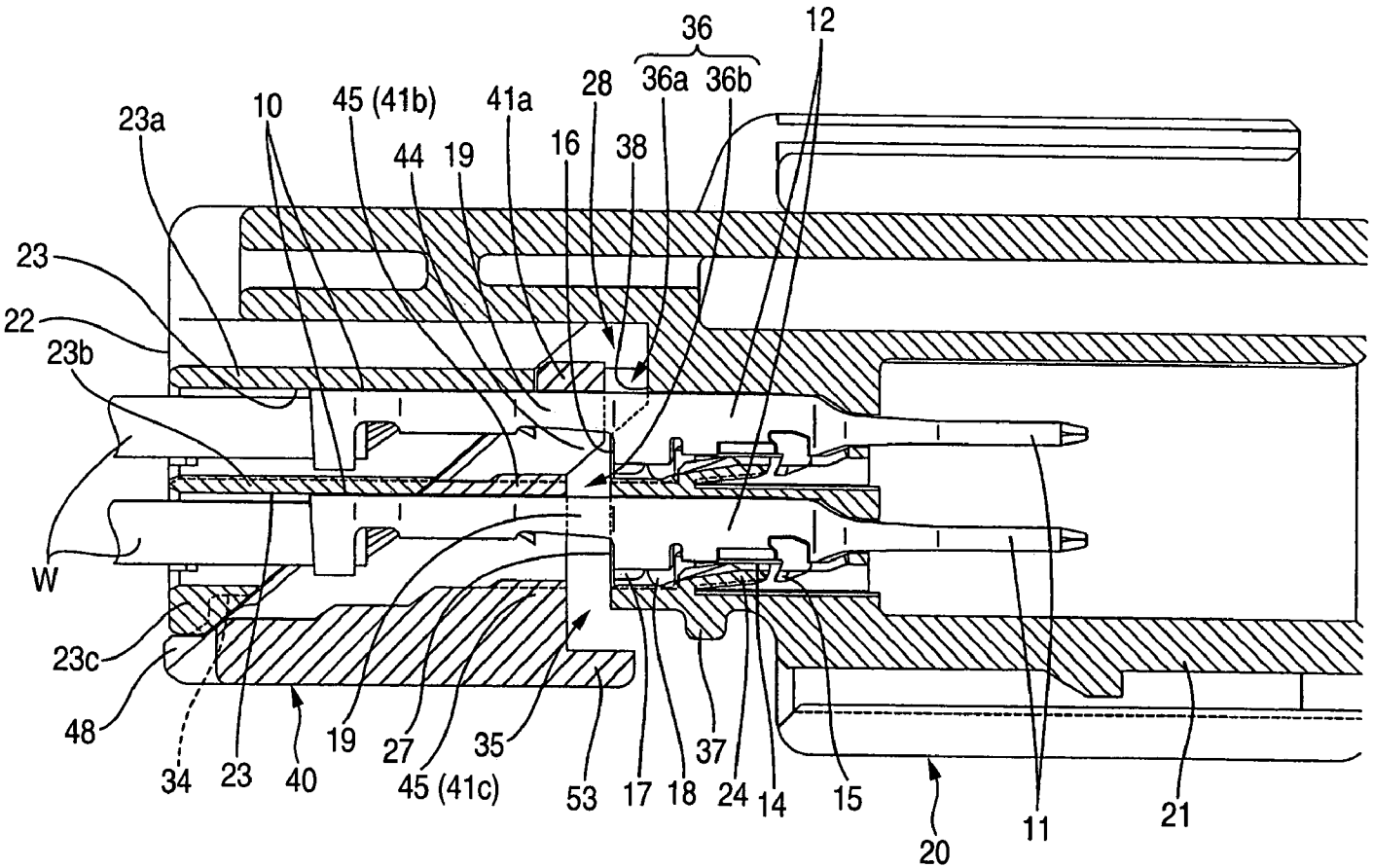
FIG. 11 is a side sectional view showing a state of inserting the male terminal metal piece.

As shown in FIG. 11, the upper side portion 36*a* of the gap 36 formed between the projected portion 44 and the recess portion 38 is arranged at a position of exposing a portion (upper portion of rear end) of the main body portion 12 of the male terminal metal piece 10 inserted into the cavity 23 at the upper stage to outside in the side directions. In contrast thereto, the lower side portion 36*b* of the gap 36 is arranged at a position of exposing a portion (front half portion) of the connecting portion 19 on the rear side of the main body portion 12 of the male terminal metal piece 10 inserted into the cavity 23 at the lower stage to an outside in the side directions. Further, although the lower side portion 36*b* of the gap 36 opens a portion of the cavity 23 at the upper stage in the side directions, since the position is at a portion on the rear side of the locking stepped portion 16 of the male terminal metal piece 10 and on the lower side of the connecting portion 19, the male terminal metal piece 10 at the upper stage is not exposed to the portion. In this way, although the upper side portion 36*a* and the lower side portion 36*b* expose the male terminal metal pieces 10 respectively inserted into the cavities 23 having different heights, the exposed portions are positionally shifted in the front and rear direction between the upper stage and the lower stage. Further, the upper side portion 36*a* and the lower side portion 36*b* of the gap 36 are connected to each other in view of a relationship of a dimension of a length of the above-described projected portion 44 and an opening region in the front and rear direction is gradually narrowed as approaching a boundary position thereof.

Further, the retainer 40 is provided with a restricting portion 53 capable of restricting an outside foreign object from penetrating inside of the cavity by being projected to a side of the gap 35 opened downwardly. The restricting portion 53 is provided by being projected from a front face of a lower end portion of the lower portion 41*c* of the retainer main body portion 41 to the front side and a projected dimension thereof is set to be larger than a length of the gap 35 in the front and rear direction. According to the restricting portion 53, a width dimension is set to be substantially the same as that of the retainer main body portion 41 (smaller than that of the terminal containing portion 22 of the male housing 20) and both side portions in a width direction thereof are formed with taper faces by cutting corner portions thereof. The restricting portion 53 is made to be able to cover the gap 35 opened downwardly along the width direction substantially over an entire region thereof and is arranged by opening a predetermined interval (an amount of a height of moving the retainer 40 from a lower face of the terminal containing portion 22) from the lower face of the terminal containing portion 22.

When the retainer 40 is mounted to the full locking position, an upper face of the restricting portion 53 is made to be able to be brought into contact with a lower face of the terminal containing portion 22. At this occasion, a front side of the restricting portion 53 is arranged with a catch preventing portion 37 provided at the terminal containing portion 22 to be proximate to each other to open a slight gap (to a degree of being sufficiently narrower than a diameter of the electric wire) therebetween to thereby prevent the outside electric wire or the like from being caught by the restricting portion 53. The catch preventing portion 37 is provided to project to the lower side at a position of the lower face of the terminal containing portion 22 frontward from the retainer mounting hole 27 and a projected dimension thereof is made to be smaller than a thickness dimension of the restricting portion 53. A width dimension of the catch preventing portion 37 is set to be larger than a size over an entire width of the terminal containing portion 22, that is, larger than the restricting portion 53.

The first embodiment is constituted by the above-described structure and operation thereof will successively be explained. First, a method of molding the male housing 20 and the retainer 40 will be explained. Generally, the male housing 20 and the retainer 40 are molded by a resin at inside of the same molding die and the retainer 40 is integrated to the male housing 20 at the partial locking position at inside of the die.

Figure 15A:
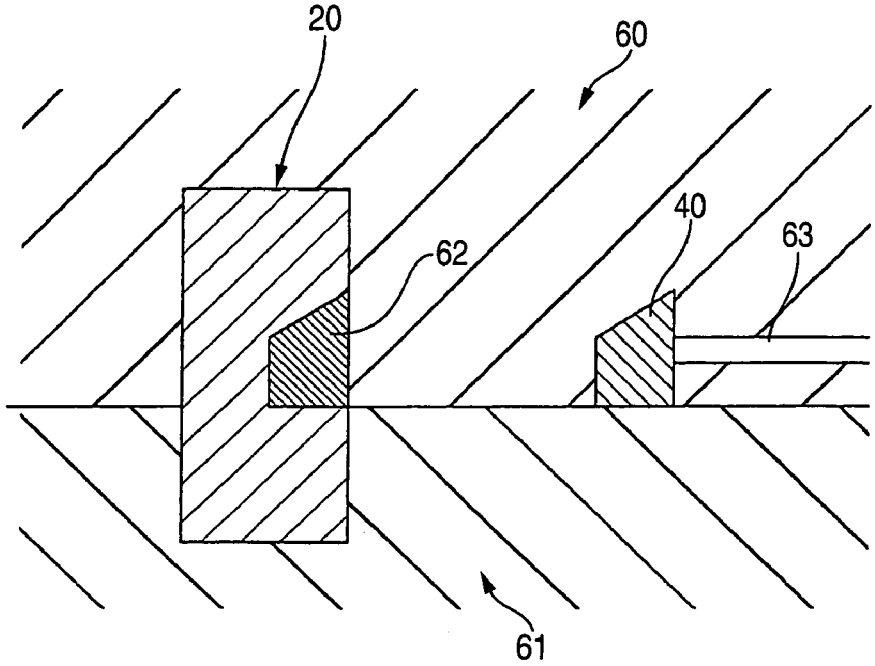
FIGS. 15A and 15B illustrate sectional views showing an outline of a situation of molding the male housing and the retainer.
Figure 15B:
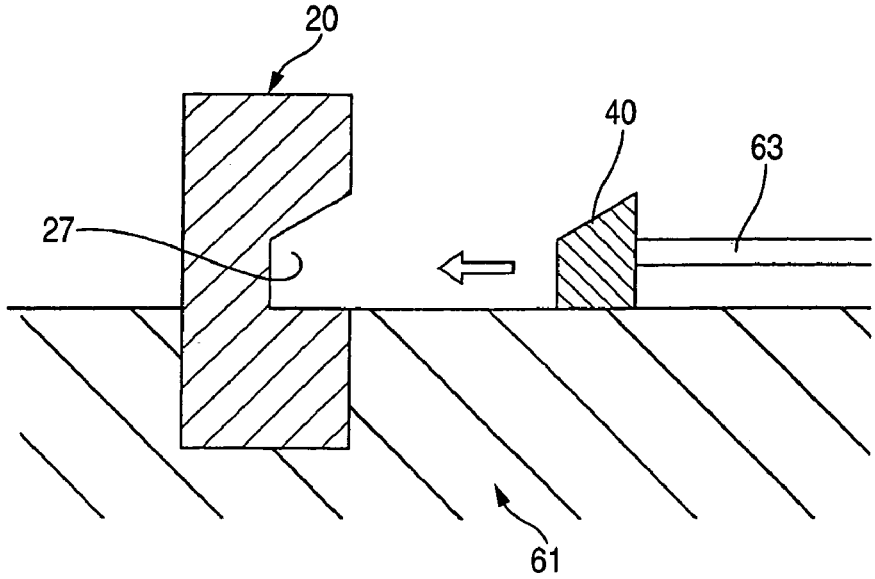

In details, as shown in FIGS. 15A and 15B, a total of the male housing 20 is molded by a pair of dies 60, 61 opened and closed along a direction of a length of the cavity 23 (up and down direction of the illustration), and the retainer mounting hole 27 is molded by a sliding die 62 moved forward and rearward along a direction orthogonal to the above-described direction and also orthogonal to the direction of mounting the retainer 40 (direction orthogonal to paper face of the drawing), that is, the sliding die 62 moving into and back from the side of the male housing 20. Further, also the retainer 40 is molded at a position on the right side of the illustration of the portion of molding the retainer mounting hole in dies the same as the dies 60, 61 for molding the male housing 20. Further, after opening the dies, when the retainer 40 is pushed to the retainer mounting hole 27 by a pushing pin 63, the retainer 40 can be mounted to the partial locking position. That is, the inner-die integrating (inner-die assembly) is carried out.

When the retainer 40 is mounted to the male housing 20 at the partial locking position in this way, as shown in FIG. 8, the male terminal metal pieces 10 are inserted from the rear side into the respective cavities 23. Then, operation of inserting the male terminal metal piece 10 is smoothly guided by inserting the locking projected portion 15, the stabilizer 18 and the projected portion 17 into the projected portion inserting groove 25, the stabilizer inserting groove 26 and the stabilizer passing groove 46 successively in correspondence therewith. When the male terminal metal piece 10 is inserted to a predetermined depth, the lance 24 is pressed by the locking projected portion 15 to temporarily be deformed to bend to the lower side. Further, when the male terminal metal piece 10 reaches a regular depth, as shown in FIG. 11, the locking projected portion 15 rides over the lance 24, the lance 24 is elastically recovered to advance into the recess portion 14 to be locked by a front edge of the recess portion 14 and a rear end face of the locking projected portion 15.

Figure 12:
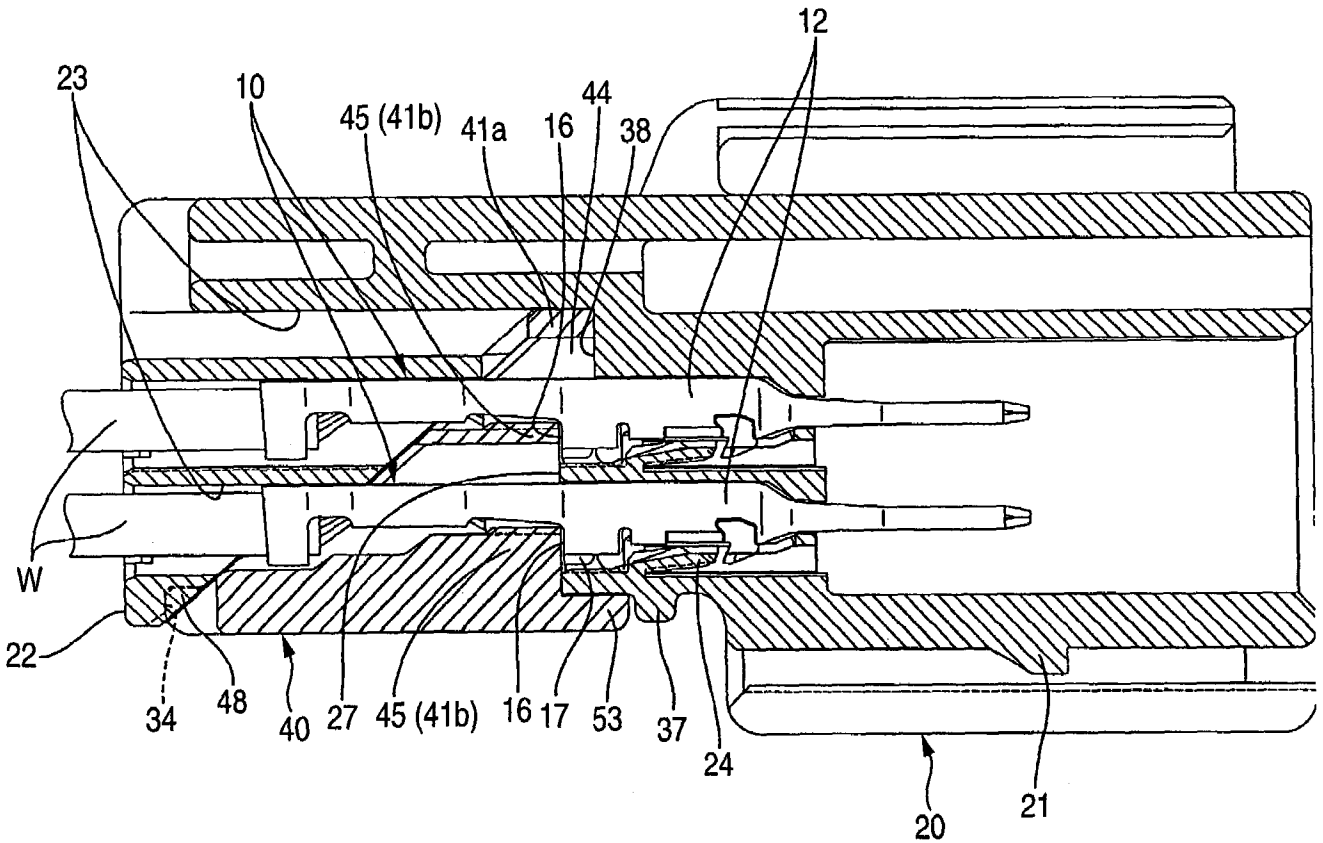
FIG. 12 is a side sectional view showing a state of arranging the retainer at a full locking position.
Figure 14:
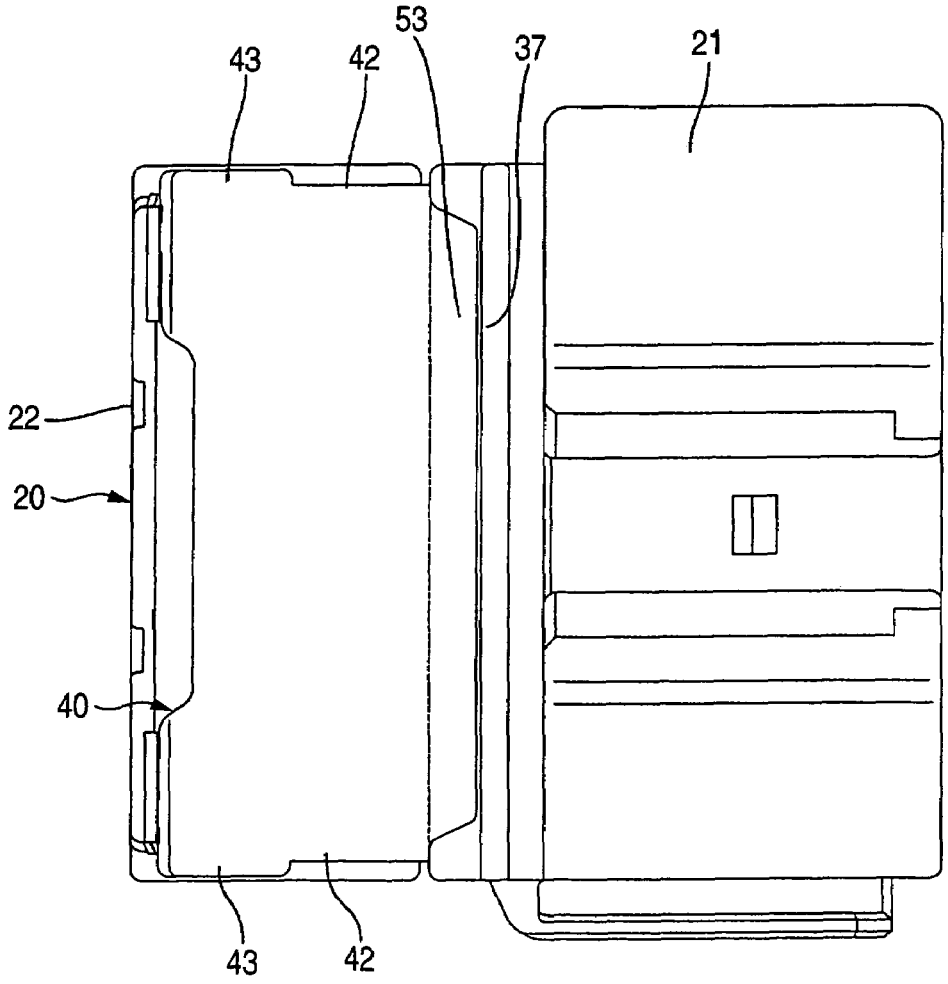
FIG. 14 is a bottom view showing the state of arranging the retainer at the full locking position.

When all of the male terminal metal pieces 10 have been finished to insert, there is carried out operation of moving the retainer 40 from the partial locking position to the full locking position. When the retainer 40 is pressed in a skewed upper front direction, the periphery of the lower end portion of the guide groove 49 is deformed to ride over the press restricting portion 31 to move out from the guide groove 49, the retainer 40 is operated to guide by fitting together the locking projection 30 and the guide groove 49 to be pressed in the skewed upper direction. Further, when the retainer 40 reaches the full locking positions, as shown in FIG. 12, the respective drawout preventing portions 45 advance into the respective cavities 23 to be locked by the locking stepped portions 16 and the rear end faces of the projected portions 17 of the male terminal metal pieces 10 in correspondence therewith to thereby doubly prevent the male terminal metal pieces 10 from being drawn out. When the retainer 40 reaches the full locking position, as shown in FIG. 14, the restricting portion 53 is arranged at be proximate to an immediate rear side of the catch preventing portion 37. By the catch preventing portion 37, the outside electric wire or the like is prevented from being caught by the restricting portion 53 to thereby prevent a situation of pulling the retainer 40 by the caught electric wire to move to the side of the partial locking position.

At the full locking positions, as shown in FIG. 13, the locking projection 30 is locked by the lower end of the guide groove 49 and the press restricting projection 31 is disposed to shift to the rear side of the operating portion 43. Further, at this occasion, in addition to locking the locking claw 52 by the upper edge of the catching piece 33 by riding over the taper face 33*a* of the catching piece 33, the locking portion 48 advances into the recess portion 34 to lock a rear face thereof by a front face of the locking recess portion 34 to thereby doubly hold the retainer 40 at the full locking position (FIG. 12). Further, by locking the lower edge of the jouncing restricting portion 32 by the lower edge of the restricting recess portion 51, jouncing of the retainer 40 to the upper side is also restricted. Further, at the full locking position, the front edge of the retainer main body portion 41 is substantially brought into contact with the front edge of the retainer mounting hole 27 including the projected portion 44 and the recess portion 38, the both members are closed substantially without a gap and therefore, dust and dirt or the like can be prevented from penetrating inside of the cavity 23. When the male connector has been finished to integrate as described above, the counter female connector, not illustrated, is connected to fit to inside of the hood portion 21.

In the state of fitting together the two connectors, there is a concern of returning the male connector 40 to the partial locking position unexpectedly by some situation, then, as shown in FIG. 11, the gaps 35, 36 are opened between the front edge of the retainer 40 and the front edge of the retainer mounting hole 27. However, according to the gap 36 opened to the sides, the upper side portion 36*a* and the lower side portion 36*b* are positionally shifted in the front and rear direction and therefore, only a portion of the main body portion 12 of the male terminal metal piece 10 at the upper stage side is exposed to the upper side portion 36*a* and substantially an entire region of the connecting portion 19 is covered by the projected portion 44 and is hardly exposed. In contrast thereto, only a portion of the connecting portion 19 of the male terminal metal piece 10 at the lower stage side is exposed to the lower side portion 36*b* and an entire region of the main body portion 12 is covered by a peripheral wall of the cavity 23 and is not exposed. That is, portions of the male terminal metal piece 10 at the upper stage side and the male terminal metal piece 10 at the lower stage side exposed to the sides are shifted from each other in the front and rear direction, in addition thereto, the gap 36 is formed to gradually narrow as the upper side portion 36*a* and the lower side portion 36*b* approach each other and therefore, an outside tool or the like is made to be difficult to be simultaneously brought into contact with the upper and lower male terminal metal pieces 10, thereby, a situation of short-circuiting the male terminal metal pieces 10 aligned in the up and down direction is prevented. Further, at the partial locking position, the upper portion 41*a* and the middle portion 41*b* of the retainer main body portion 41 are locked by the male terminal metal pieces 10 at inside of the cavities 23 and therefore, a situation of detaching the retainer 40 from the main housing 20 is prevented.

Further, the gap 35 opened downwardly is covered by the restricting portion 53 substantially over a total width thereof and therefore, for example, an electric wire or a tool is restricted from penetrating the cavity 23. Therefore, a situation of damaging the male terminal metal piece 10 or a situation of short-circuiting the male terminal metal pieces 10 aligned in the width direction is prevented. Further, a foreign object is prevented from penetrating the cavity 23 by the restricting portion 53 even, for example, at a stage prior to inserting the male terminal metal piece 10 and in a procedure of carrying the retainer 40 to an integrating site in a state of being mounted to the partial locking position.

As has been explained above, according to the first embodiment, in a state of arranging the retainer 40 at the partial locking position, the restricting portion 53 is arranged to project into the gap 35 opened between the front edge of the retainer 40 and the front edge of the retainer mounting hole 27 and therefore, an outside foreign object can be prevented from penetrating the cavity 23.

Further, according to the male connector, the retainer mounting hole 27 is opened in the three directions and therefore, when a foreign object of a long electric wire or the like assumedly invades the gap 35, the foreign object is liable to interfere with the male terminal metal piece 10, however, by previously restricting the foreign object from penetrating by the restricting portion 53, such a situation can be prevented beforehand.

Further, in a state of mounting the retainer 40 to the full locking position, by arranging the catch preventing portion 37 proximately to the restricting portion 53, an outside electric wire or the like can be prevented from being caught by the restricting portion 53, thereby, the retainer 40 can be prevented from being positionally shifted to the side of the partial locking position.

As has been explained above, according to the first embodiment, in the gap 36 formed between the front edge of the retainer 40 and the front edge of the retainer mounting hole 27 by the projected portion 44 provided at the front edge of the retainer 40 to project to the front side and the recess portion 38 formed at the front edge of the retainer mounting hole 27 to recess, the upper side portion 36*a* in correspondence with the male terminal metal piece 10 at inside of the cavity 23 at the upper stage and the lower side portion 36*b* in correspondence with the male terminal metal piece 10 at inside of the cavity 23 at the lower stage are arranged to be positionally shifted from each other in the front and rear direction and therefore, a situation of bringing an outside foreign object simultaneously into contact with the male terminal metal pieces 10 at inside of the respective cavities having different heights and therefore, the male terminal metal pieces 10 can be prevented from being short-circuited to each other.

Further, the retainer main body portion 41 is formed substantially in a shape of a lattice permitting to insert and draw the male terminal metal pieces 10 communicate with the respective cavities 23 at the partial locking position and therefore, when the male terminal metal piece 10 is inserted into at least any one of the respective cavities 23, the retainer 40 can be locked by the male terminal metal piece 10 and therefore, a situation of detaching the retainer 40 from the partial locking position can be prevented. Further, according to the embodiment, for convenience of constituting the retainer main body portion 41 substantially in a shape of a lattice (for escaping the upper portion 41*a*), the retainer mounting hole 27 is formed by a depth reaching a position further upward from the upper wall 23*a* of the cavity 23 at the upper stage and therefore, the male terminal metal piece 10 inserted into the cavity 23 at the upper stage is exposed to outside in the side directions.

The invention is not limited to the first embodiment explained by the above description and the drawings but, for example, the following embodiments are also included in the technical range of the invention, further, the invention can be embodied by being variously changed within the range not deviated from the gist other than described below.

According to the first embodiment, the gap is covered by the single restricting portion, the gap may partially be covered by, for example, a plurality of restricting portions and a number and a shape of the restricting portions can arbitrarily be set. Further, a number and a shape of the catch preventing portions can similarly be set arbitrarily and also be omitted depending on cases.

In the first embodiment, the case of providing the restricting portion to the retainer has been shown, the restricting portion may be provided to the female housing, or the restricting portions may be provided to both of the retainer and the male housing. Further, when the restricting portion is provided on the side of the male housing, an escapement when mounted to the full locking position needs to provide on the side of the retainer.

According to the first embodiment, there is shown the retainer mounting hole opened in the three directions, the invention is applicable to the retainer mounting hole opened only in one direction (lower direction).

Although the first embodiment shows the case of forming the projected portion over substantially an entire width of the retainer main body portion, for example, the projected portion may partially be provided only at end portions on both sides of the retainer main body portion, and a number and a shape of the projected portions can arbitrarily be set. Further, a number and a shape of the recess portions can similarly be set arbitrarily to adjust to the projected portions. Further, the shapes of the projected portion and the recess portion may substantially be adjusted to each other and need not to completely coincide with each other.

Although the first embodiment shows the case of providing the projected portion at the retainer, the projected portion may be provided at the male housing, or the projected portions may be provided to both of the retainer and the main housing. Further, when the projected portion is provided on the side of the male housing, the recess portion for escaping the projected portion when mounted to the full locking position needs to provide on the side of the retainer.

Although the first embodiment shows the constitution of forming the retainer main body portion in the shape of the lattice, the invention is applicable to a constitution of omitting the upper portion of the retainer main body portion and the side portion connecting the upper portion and the middle portion.

Although the first embodiment exemplifies the connector having the two upper and lower stage, the invention is applicable also to a connector having three or more stages in an up and down direction.

Although the first embodiment exemplifies the connector on the male side, the invention is applicable also to a connector on a female side containing a female terminal metal piece.

Although the first embodiment exemplifies the case of carrying out so-called inner-die assembly in fabricating steps, there may be carried out so-called separate assigning in which, for example, the housing and the retainer are molded by a resin by respectively separate molding dies, and after opening the dies, an operator integrates the retainer to the housing at the partial locking position. In sum, by constituting the retainer mounting hole by the mode of opening in three directions, in the fabricating steps, the inner-die assembly and the separate assigning can selectively be adopted, which is convenient.

Hereinafter, a second embodiment of the invention will be explained in reference to FIG. 16 through FIG. 31B. According to the second embodiment, a male side connector that is to be installed in a vehicle is exemplified. The connector is generally constituted by a mail connector housing 520 (hereinafter, simply referred to as the male housing 520), a male terminal metal piece 510 contained at inside of the mail housing 520, and a retainer 540 mounted to the mail housing 520. Further, in the following, a direction of inserting the male terminal metal piece 510 to the mail housing 520 is made to constitute a front direction and a direction of drawing the male terminal metal piece 510 therefrom inverse thereto is made to constitute a rear direction. Further, a reference of an up and down direction is constituted by respective drawings except FIGS. 18 and 31B.

Figure 23:
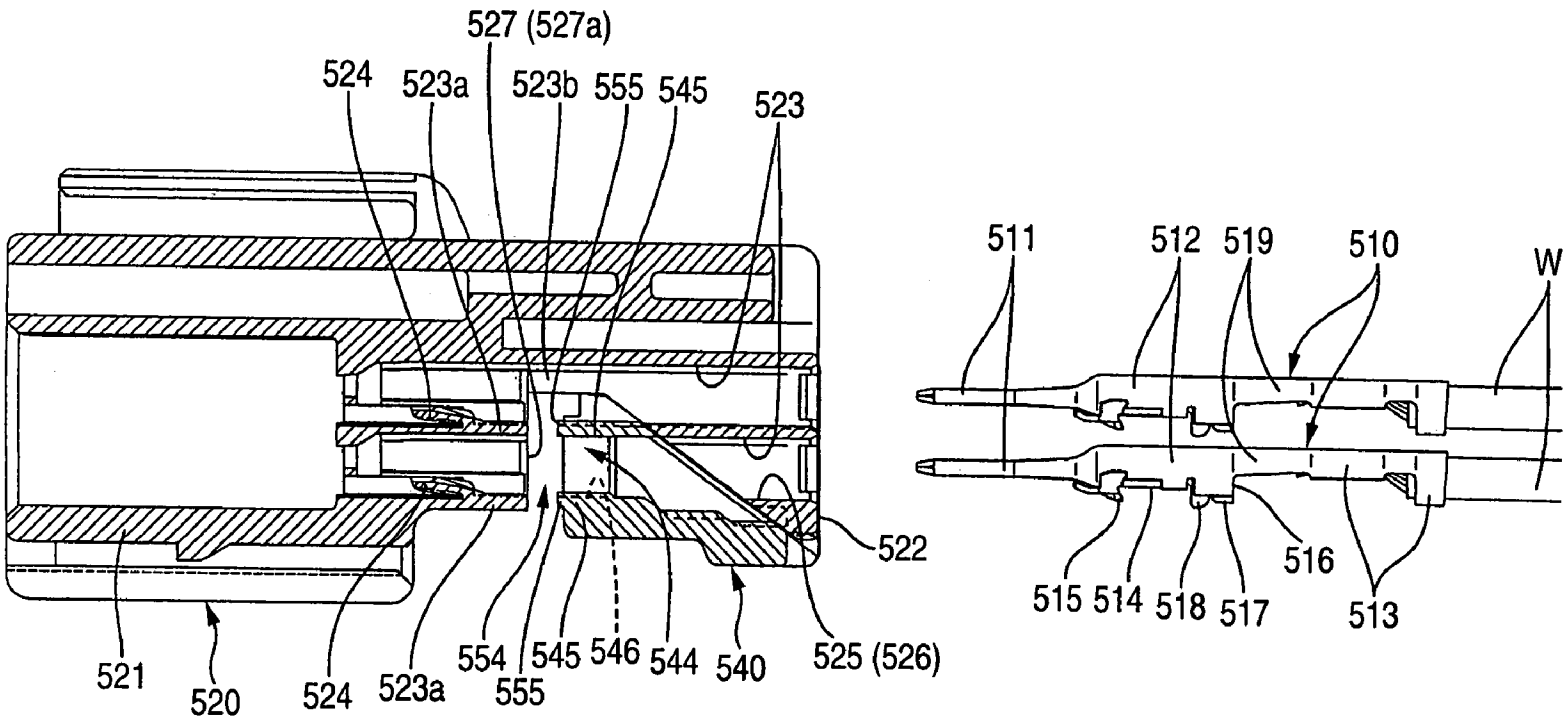
FIG. 23 is a side sectional view of a male terminal metal piece and the male housing mounted with the retainer at a partial locking position.

First, the male terminal metal piece 510 will be explained. The male terminal metal piece 510 is formed by bending a metal plate punched into a predetermined development shape and is constituted by a tab portion 511 capable of being connected to contact to a counter female metal piece (not illustrated), a main body portion 512 constituting substantially a box-like shape, and a barrel portion 513 connected to be brought into press contact with a terminal of an electric wire W successively from a front side as shown in FIG. 23. The tab portion 511 is formed by bending a slender plate piece extended from a front edge of the main body portion 512 to be brought into close contact along a length direction thereof. The barrel portion 513 is provided with pairs of calking pieces opposedly at front and rear sides thereof, whereas the two calking pieces on the front side are calked to a core line of the electric wire W, the two calking pieces on the rear side are calked to a cover of the electric wire W. The barrel portion 513 is connected to a substantially upper half at a rear end of the main body portion 512 by a connecting portion 519.

Substantially at a center in a length direction of a lower face of the main body portion 512 (outer face opposed to a lance 524) a recess portion 514 for permitting advancement of the lance 524 is formed and an upper portion of the lance 524 is locked by a front edge thereof. At the front edge of the recess portion 514, a locking projecting portion 515 for locking a lower portion of the lance 524 is struck out to form to project to a lower side. A stepped difference portion formed at a rear end portion of a lower face of the main body portion 512 is made to constitute a locking stepped portion 516 for locking the retainer. At the locked stepped portion 516, a projected portion 517 projected to a height substantially the same as that of the locking projected portion 515. At a position immediate frontward from the projected portion 517, a stabilizer 518 projected further to a lower side of the projected portion 517 is formed and the stabilizer 518 functions to stabilize operation of inserting the male terminal metal piece 510 and prevent inverse insertion thereof.

Next, the male housing 520 will be explained. The male housing 520 is made of a synthetic resin and is constituted to connect a hood portion 521 capable of fitting the counter female connector from a front side and a terminal containing portion 522 capable of containing the male terminal metal piece 510. The hood portion 521 is formed substantially in a shape of a square cylinder opened to the front side and an upper face side of an inner peripheral face thereof is provided with a locking portion (not illustrated) capable of holding the female connector in a fitted state by locking a lock arm provided at the female connector.

Figure 17:
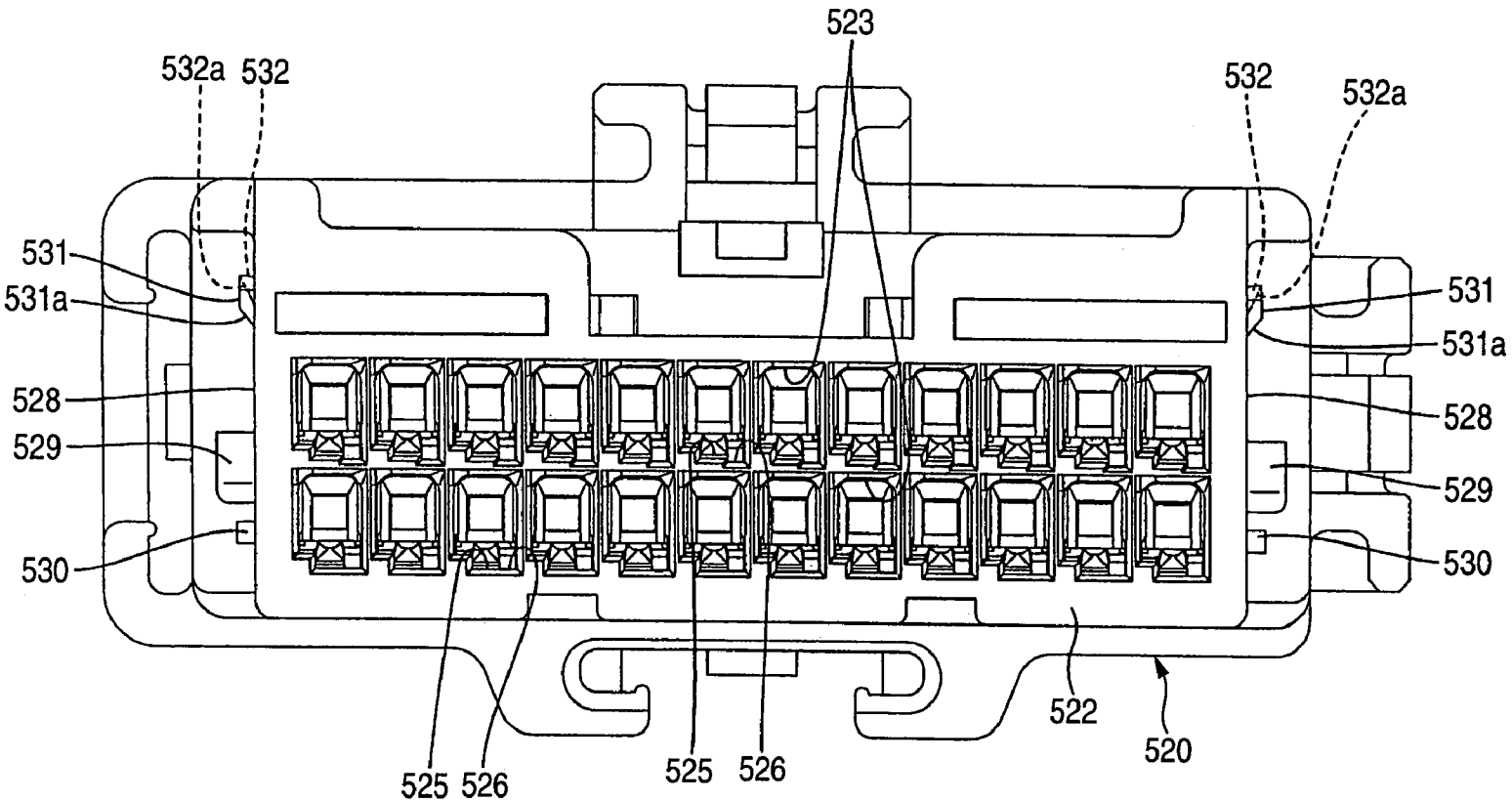
FIG. 17 is a rear view of the male housing.
Figure 18:
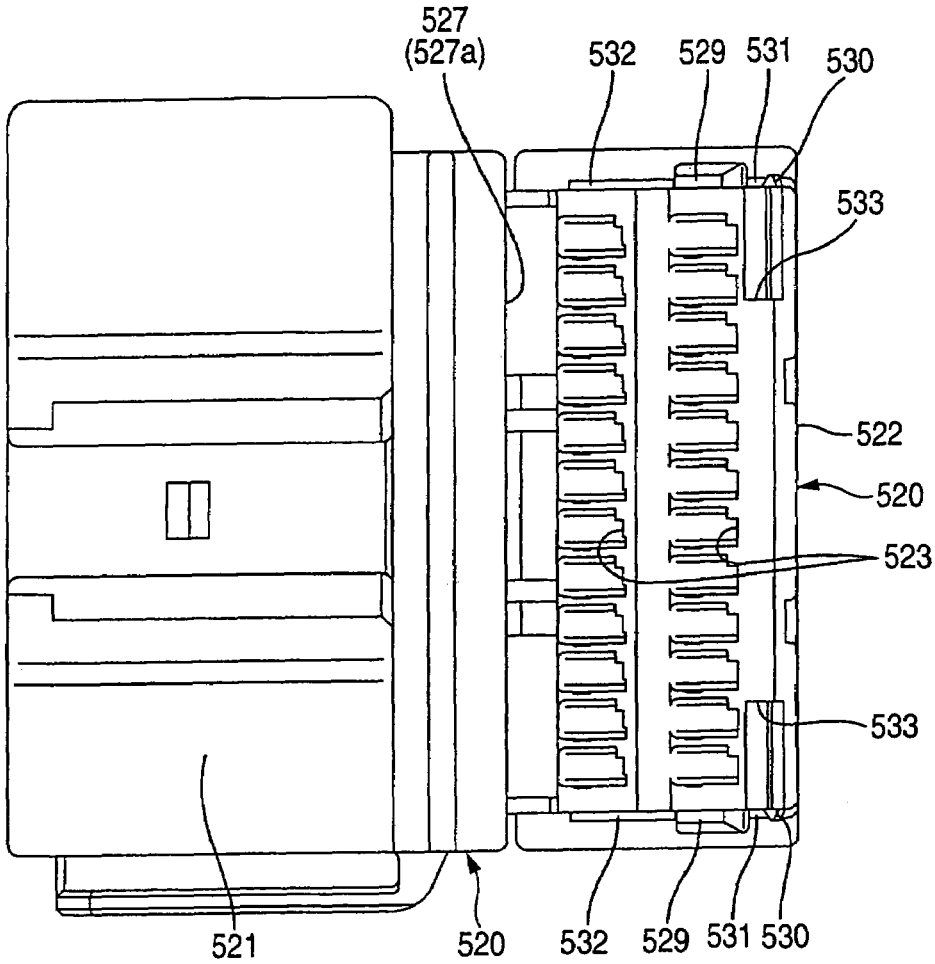
FIG. 18 is a bottom view of the male housing.

As shown in FIG. 17 and FIG. 23, terminal containing portion 522 is formed substantially in a block-like shape in a width direction, inside thereof is provided with a cavity 523 capable of inserting the male terminal metal piece 510 from a rear side, the cavity 523 is formed to penetrate the male housing 520 along a front and rear direction and the cavities 523 are arranged to align in the width direction by a plurality of chambers thereof at two upper and lower stages. A lance 524 capable of being elastically locked by the male terminal metal piece 510 is provided from a lower face of each cavity 523. The lance 524 is formed to extend to a front side in a cantilever shape and is made to be able to deform to bend in an up and down direction (direction intersecting with the direction of inserting and drawing the male terminal metal piece 510). The lance 524 is deformed to bend temporarily to a lower side by being pressed by the male terminal metal piece 510 inserted into the cavity 523, and when the male terminal metal piece 510 reaches a regular depth, the lance 524 is recovered to be locked by a front edge of the recess portion 514 and a locking projected portion 515 of the male terminal metal piece 510. In a state in which the male terminal metal piece 510 reaches the regular depth, the locking stepped portion 516 and the projected portion 517 are arranged frontward from a front edge 527*a* of a retainer mounting hole 527, mentioned later, by a predetermined distance A (in correspondence with a dimension of projecting a pressing projected portion 555) (refer to FIG. 29). A predetermined clearance is ensured between the lance 524 and the front edge of the recess portion 514 and the locking projected portion 515 of the male terminal metal piece 510 reaching the regular depth in order to permit the lance 524 in the cantilever shape to recover (deformed to bend) and therefore, the male terminal metal piece 510 reaching the regular depth is made to be able to idly move rearwardly within a range of the clearance.

Further, a projected portion inserting groove 525 capable of inserting the locking projected portion 515 and the projected portion 517 are formed to recess substantially at a center in a width direction of a lower face of the cavity 523 over an entire length thereof and a stabilizer inserting groove 526 capable of inserting the stabilizer 518 is formed to recess at a left side edge (one corner portion) thereof in FIG. 17. The projected portion inserting groove 525 is formed over an entire length of the above-described lance 524 to thereby reduce an amount of bending the lance 524 in inserting the male terminal metal piece 510. Further, the stabilizer inserting groove 526 reaches a position of the lance 524 slightly rearward from a base end portion thereof and is opened only to the rear side. Further, whereas the stabilizer inserting groove 526 is formed to be deeper than the projected portion inserting groove 525 on a side of the upper stage, on a side of the lower stage, the projected portion inserting groove 525 is set to a depth substantially the same as that of the stabilizer inserting groove 526.

An outer peripheral face of the terminal containing portion 522 is opened with the retainer mounting hole 527 for mounting the retainer 40. The retainer mounting hole 527 is formed over a three faces region from a lower face (face opposed to the direction of mounting the retainer 540) over to two side faces (faces along the direction of mounting the retainer 540) in the male housing 520. Therefore, the retainer mounting hole 527 is constituted by a mode of opening in three directions of a lower direction (direction of mounting the retainer 540) and two side directions (directions orthogonal to the direction of mounting the retainer 540). The retainer mounting hole 527 is formed to open all of the cavities 523 to outside and formed to a depth of notching substantially a lower half of a side wall 23*b* of the cavity 523 at the upper stage (partitioning wall of the cavity 523 in the width direction). That is, the retainer mounting hole 527 is formed to a depth of opening a path of inserting the locking stepped portion 516 and the projected portion 517 provided at a rear end of the main body portion 512 in the above-described three directions in the male terminal metal piece 510 inserted into the cavity 523, and a substantially an upper half of the main body portion 512 and the path of inserting the connecting portion 519 are not opened to the both sides by leaving the side wall 523*b* of the cavity 523. By the retainer mounting hole 527, a lower wall 523*a* of the cavity 523 at the upper stage (upper wall of the cavity 523 at the lower stage, in other words, partitioning wall of the upper and lower cavities 523), and the two side walls 523*b* and the lower wall 523*a* (outer wall of the male housing 520) of the cavity 523 at the lower stage are divided in the front and rear direction. Further, a dimension of a length of a portion of the retainer mounting hole 527 of the cavity 523 frontward from the front edge 527*a* is set to be larger than a length necessary for containing the main body portion 512 of the male terminal metal piece 510 by a predetermined length (in correspondence with a dimension of projecting the pressing projected portion 555). Although the front edge 527*a* of the retainer mounting hole 527 is formed to erect substantially straightly along an up and down direction, a rear edge thereof is formed by an inclination constituting a downward slope to the rear side and an inclined angle thereof is set to about 35 degrees (smaller than 45 degrees) to the direction of inserting the male terminal metal piece 510. Further, the mounted retainer 540 is made to be movable along the inclination of the rear edge of the retainer mounting hole 527.

Figure 16:
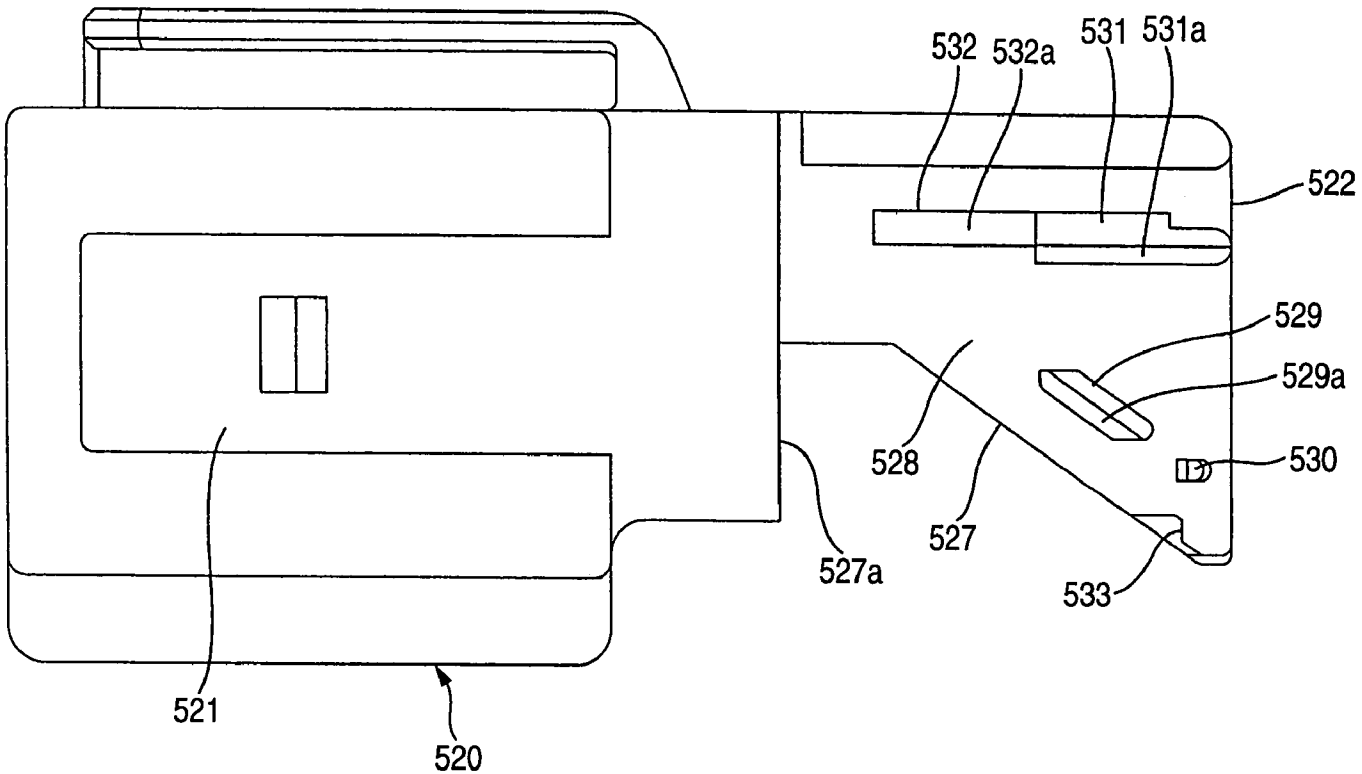
FIG. 16 is a side view of a male housing according to a second embodiment of the invention.
Figure 22:
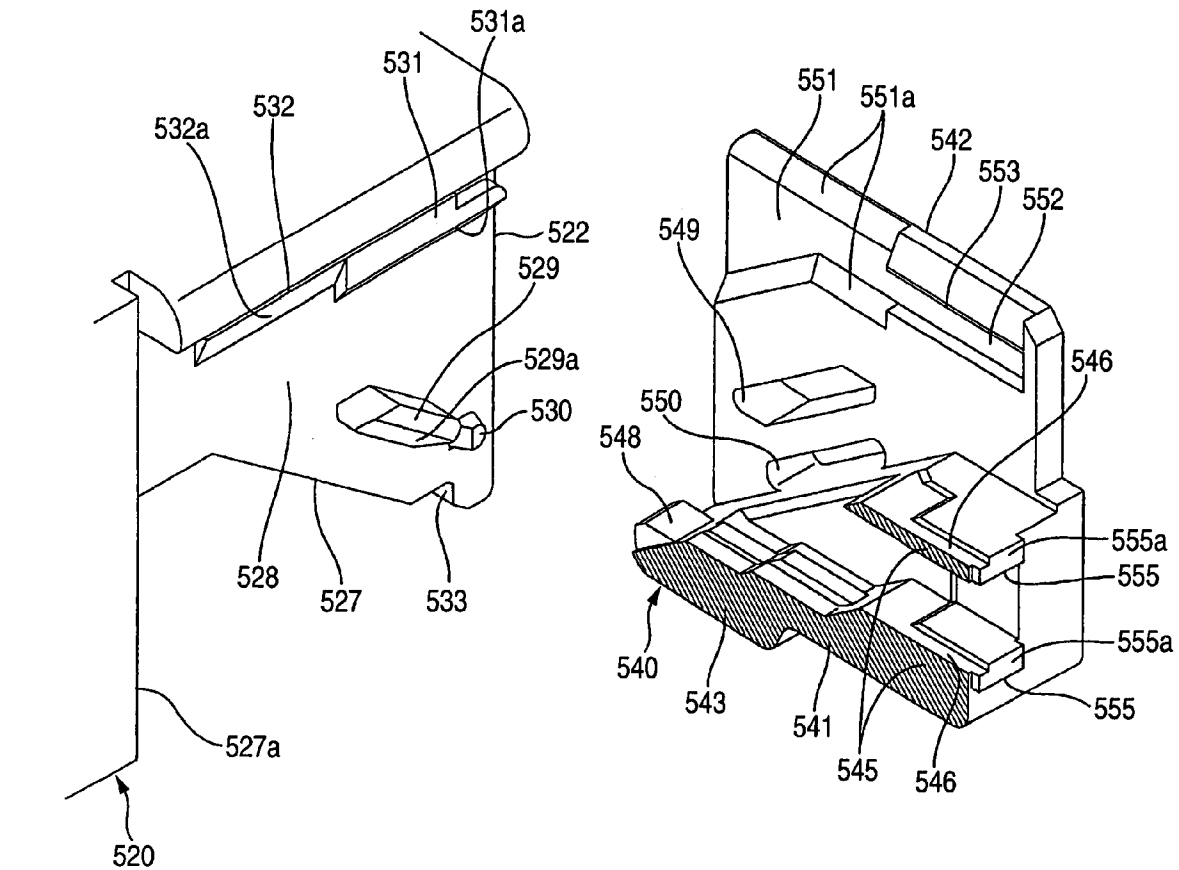
FIG. 22 is a perspective view showing respective peripheral portions of a locking projection and a guide groove.

As shown in FIG. 16 and FIG. 22, in two outer side faces of the terminal containing portion 522, a predetermined region of an upper side and a rear side of a side face opening portion of the retainer mounting hole 527 is made to constitute a stepped difference face 528 recessed by one stage to which a side plate 542 of the retainer 540 can be mounted. The stepped difference face 528 is provided with a locking projection 529 in a rib-like shape along an inclination of a rear edge of the retainer mounting hole 527. The locking projection 529 mainly serves to stabilize a pressing attitude when the retainer 540 is pressed to mount to the male housing 520. Further, one side (lower side, side proximate to the retainer mounting hole 527) from an outer face of the locking projection 529 constituting a boundary by a center line in a length direction thereof is provided with a facing 529*a* over an entire face thereof to thereby enable to smoothly carry out operation of fitting the retainer 540 to a guide groove 549 of the retainer 540. Further, two upper and lower end faces of the locking projection 529 are respectively formed with horizontal faces and the end face on the upper side is also formed with a vertical face continuous to the horizontal face.

Further, a press restricting projection 530 is formed to project on an extended line of a lower portion of the locking projection 529. The press restricting projection 530 is arranged to be separate from the locking projection 529 by a predetermined distance to restrict pressing such that the retainer 540 is not pressed erroneously to the full locking position so far as an operating force equal to or larger than a predetermined force is not exerted thereto by being locked by a lower end of the guide groove 549 of the retainer 540 when the retainer 540 is disposed at the partial locking position (position shown in FIG. 23 through FIG. 25). Further, the press restricting projection 530 is made to be able to be locked by a rear edge of the retainer 540 when the retainer 540 is moved to the full locking position.

A jouncing restricting portion 531 is provided to project for restraining jouncing when the retainer 540 is disposed at the full locking position (position shown in FIG. 26 and FIG. 27) in the stepped difference face 528 on an upper side of the above-described locking projection 529. The jouncing restricting portion 531 is constituted by a mode of extending substantially horizontally along the front and rear direction. Meanwhile, a side of a lower face of the jouncing restricting portion 531 is formed with a taper face 531*a* constituting an upward slope to an upper side over an entire length thereof. Further, a holding portion 532 is formed to project on a front side of the jouncing restricting portion 531. An upper edge of the holding portion 532 is formed to be continuous to an upper edge of the jouncing restricting portion 531 and can hold the retainer 540 at the full locking position by being locked by a locking claw 553 of the retainer 540, mentioned later, when the retainer 540 is disposed at the full locking position. Incidentally, a side of a lower face of the holding portion 532 is formed with a taper face 531*a* constituting an upward slope to the upper side to thereby make operation of riding over of the locking claw 553 smooth. Further, in a rear edge of the retainer mounting hole 527, lower end portions of two ends in the width direction are provided with locking recess portions 33 capable of holding the retainer 540 in a state of being restricted from being displaced to the rear side from the full locking position by being locked by locking portions 548 of the retainer 540. A rear face of the locking recess portion locked by the locking portion 48 is constituted by a face erected straightly along the up and down direction.

Figure 19:
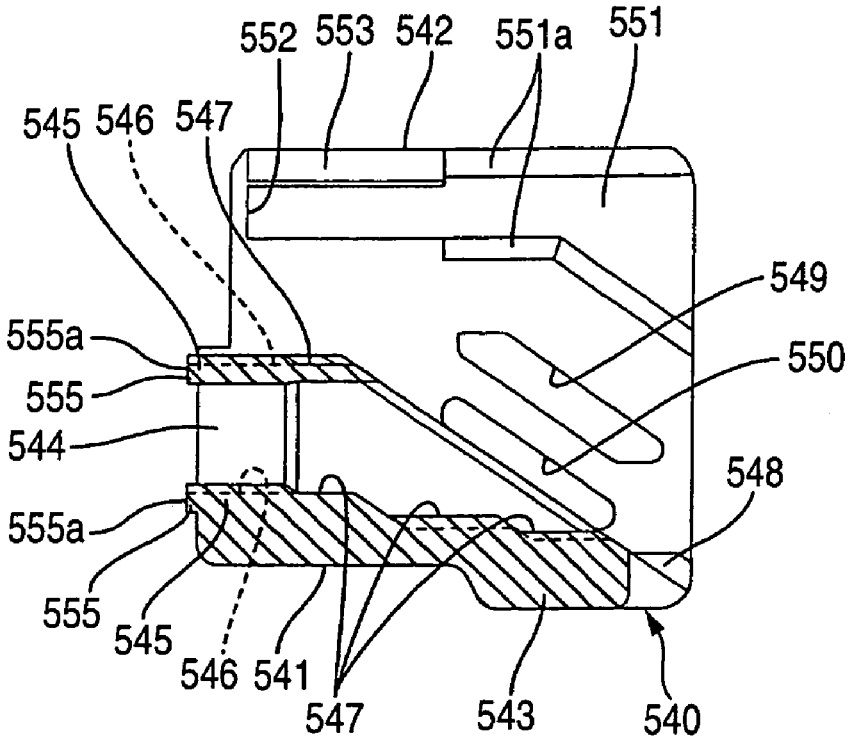
FIG. 19 is a side sectional view of a retainer.
Figure 20:
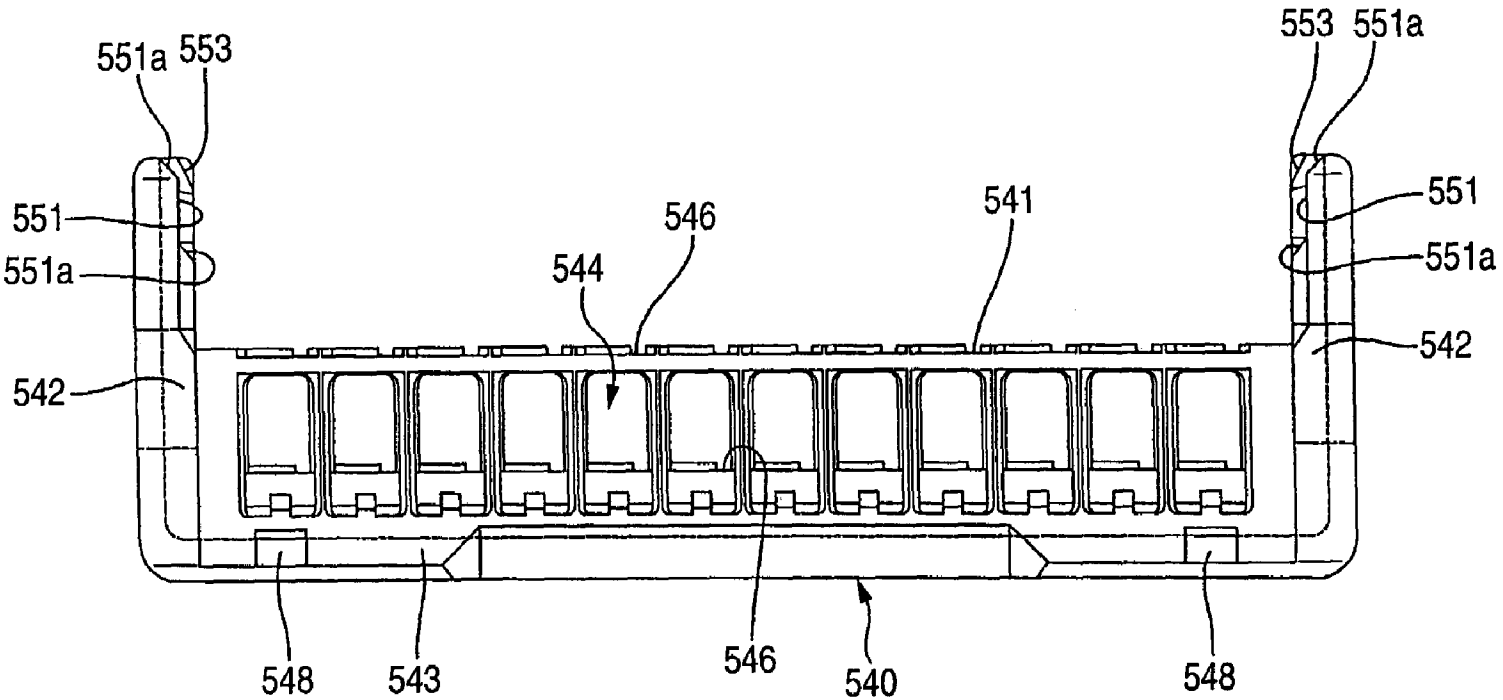
FIG. 20 is a rear view of the retainer.

Successively, the retainer 540 will be explained. The retainer 540 is formed by a synthetic resin material similar to the male housing 520 and as shown in FIG. 19, constituted by a retainer main body portion 541 fitted to adjust to the retainer mounting hole 527, and a pair of side plates 542 connected to both end portions in the width direction of the retainer main body portion 541 and mounted to the stepped difference face 528 to cover from outer sides thereof. The retainer 540 is made to be movable skewedly to the direction of inserting and drawing the male terminal metal piece 510 between the partial locking position and the full locking position, mentioned later. Further, a rear half portion of the retainer 540 (including the two side plates 542) are formed in a thick-walled shape to project in the side directions and the lower direction more than a front half portion thereof over an entire face thereof to thereby constitute an operating portion 543 capable of operating the retainer 540.

The retainer main body portion 541 is formed with window frames 44 having a number of pieces thereof the same as that of the cavities 523 at the respective stages of the male housing 520. The respective window frames 544 are formed to be able to adjust (communicate) with the respective cavities 523 at the lower stage side. Although an opening edge on a side of a front face of each window frame 544 is formed to erect straightly (vertically) along the up and down direction to adjust to the front edge 527*a* of the retainer mounting hole 527 except a portion thereof, an opening edge on a side of a rear face of each window frame 544 is formed to be inclined to adjust to a rear edge of the retainer mounting hole 527. Further, a front half portion of a lower portion of each window frame 544 and an upper portion of the retainer main body portion 541 permit to insert and draw the male terminal metal piece 510 by being adjusted generally to the lower wall 523*a* of the cavity 523 and arranged to escape from the cavity 523 when the retainer 540 is disposed at the partial locking position (FIG. 23), and made to advance into the cavity 523 when the retainer 540 is disposed at the full locking position and made to be lockable by the locking stepped portion 15 of the male terminal metal piece 510 (FIG. 26) to thereby constitute a drawout preventing portion 545 for the male terminal metal piece 510. Further, the full locking position corresponds to the regular mounting position described in the scope of claims. The drawout preventing portion 545 is formed with a stabilizer passing groove 546 capable of communicating with the stabilizer inserting groove 526 when the retainer 540 is mounted to the partial locking position. Further, a side of a rear portion of the drawout preventing portion 545 is pertinently formed with an escaping recess portion 547 for escaping a projected portion (barrel portion 513 or the like) of the male terminal metal piece 510, an electric wire W and the like. Further, lower end portions of a rear face of a pair of the window frames 544 arranged at positions of both ends in the width direction are provided with a pair of the locking portions 548 having a section substantially in a triangular shape locked by the locking recess portion 33 when the retainer 540 reaches the full locking position.

The both side plates 542 of the retainer 540 are arranged by an interval capable of riding over to interpose the two side faces of the male housing 520 and can be deformed to expand. Further, the both side plates 542 are formed by a size closing the opening portions of the side faces of the retainer mounting hole 527 when the retainer 540 is disposed at the full locking position and capable of being opposed to a predetermined range of the stepped difference face 529. Further, the both side plates 542 are formed by a thickness substantially the same as a depth of the stepped difference face 529 and when the retainer 540 is disposed at the full locking position, a face thereof is substantially flush with an outer side face of the male housing 520. Thereby, the both side plates 542 of the retainer 540 serve also as outer walls of the side face portions of the male housing 520.

Figure 24:
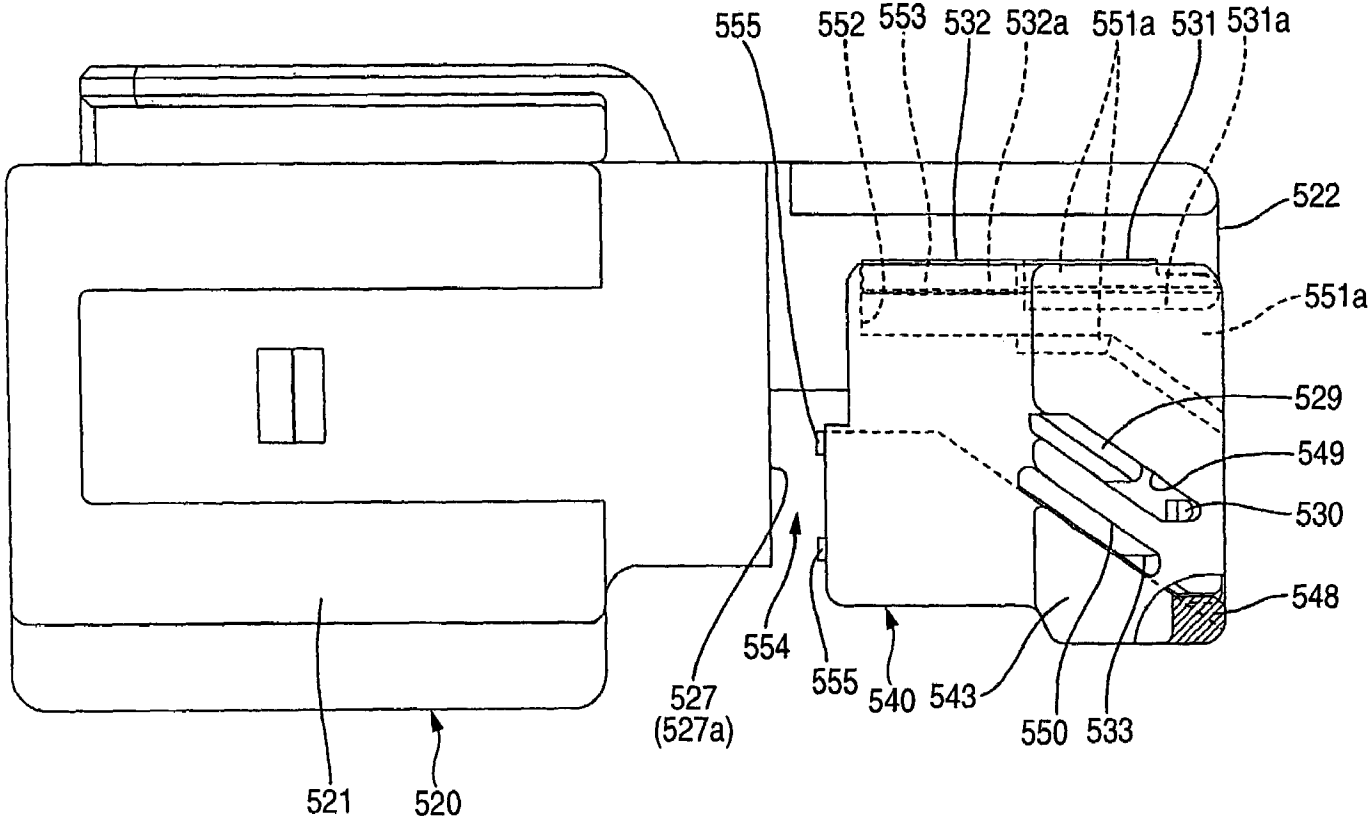
FIG. 24 is a partially cut side view of the male housing mounted with the retainer at the partial locking position.
Figure 27:
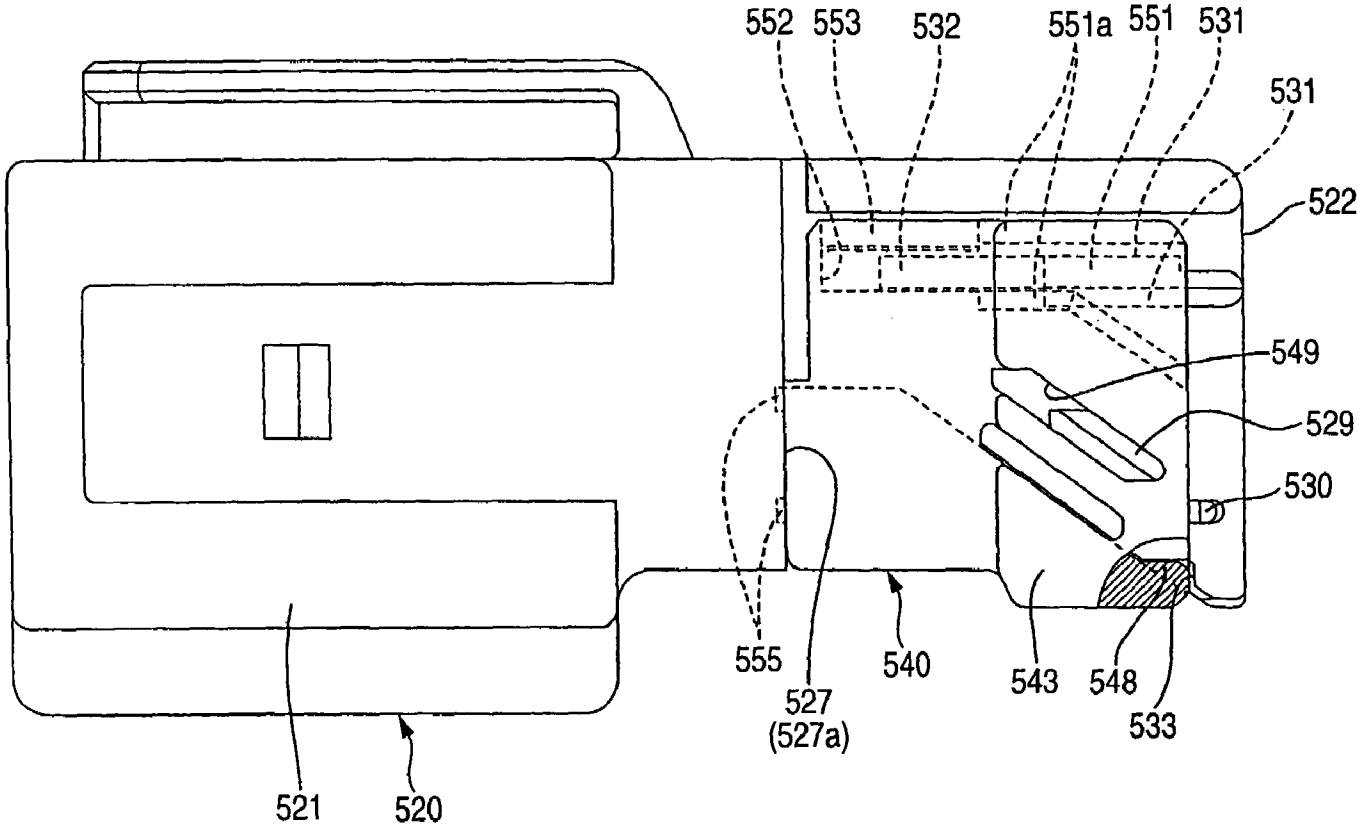
FIG. 27 is a partially cut side view showing the state of arranging the retainer at the full locking position.

As shown in FIG. 19, the guide groove 549 is formed to penetrate at a position on a rear side of the retainer main body 541 in each of the both side plates 542. The guide groove 549 is formed by a slope along an inclination of the rear edge of the retainer main body portion 541, that is, by a slope substantially the same as an inclination (a direction of moving the retainer 540) at the rear edge of the retainer mounting hole 527. Further, the guide groove 549 is formed by a groove width substantially the same as a width dimension of a short side of the locking projection 529 and both end portions thereof are formed to adjust to shapes of both end portions of the locking projection 529. Further, the guide groove 549 can lock the locking projection 529 and the press restricting projection 31 by two front and rear ends thereof to thereby hold the retainer 540 at the partial locking position (FIG. 24). Further, when the retainer 540 is moved from the partial locking position to the full locking positions, the press restricting projection 531 is made to ride over to escape from the guide groove 549, during the time period, the both side plates 542 are deformed to expand, and an amount of projecting the locking projection 529 is larger than that of the press restricting projection 531 and a locking margin having a height sufficient for continuing a state of being locked by the guide groove 549 even by deforming to expand the side plates 542. Thereby, by moving the locking projection 529 to a lower end side of the guide groove 549, the retainer 540 is brought into the regular locking state (FIG. 27). In this regular locking state, the rear end portion of the locking projection 529 is locked to the guide groove 549, and thereby, the retainer 540 is made to be movably regulated frontwardly from the full locking position. Further, a wall lightening portion 550 having an inclination substantially the same as the guide groove 549 is formed to penetrate at a position downward from the guide groove 549 in each of the both side plates 542. A groove width of the wall lightening portion 550 is set to be smaller than that of the guide groove 549 and the both side plates 542 are made to be easy to deform to expand by pertinently reducing rigidity of the both side plates 542 thereby.

Further, on an upper side of the guide groove 549 at an inner face of each of the both side plates 542, a restricting recess portion 551 capable of fitting the above-described jouncing restricting portion 531 is formed to recess and taper faces 551*a* are formed at two upper and lower edges thereof. The restricting recess portion 551 is formed over a range reaching a rear end from substantially a central portion of each of the both side plates 542 in a length direction thereof and is opened to the rear side. The restricting recess portion 551 is opened to the upper side in a height direction thereof, a lower edge thereof is formed along a shape of an upper edge of the guide groove 549, in details, whereas a front portion thereof is formed substantially horizontally along the front and rear direction, a rear portion thereof is formed in an inclined shape constituting a downward slope to the rear side. Further, when the retainer 540 is disposed at the partial locking position, an upper edge of the jouncing restricting portion 531 is held at a height position substantially aligning with an upper edge of the restricting recess portion 551 and a predetermined gap is held between a lower edge thereof and a lower edge of the restricting recess portion 551 (FIG. 24). Further, when the retainer 540 is disposed at the full locking position, the taper face 531*a* of the lower edge of the jouncing restricting portion 531 is brought into contact to adjust to the taper face 551*a* formed at the lower edge of the restricting recess portion 551 to thereby enable to restrict jouncing to the upper side (FIG. 27).

Further, the restricting recess portion 551 is extended further to the front side to expand a recess region thereof and the locking claw 553 is formed at an upper edge portion thereof. When the retainer 540 is disposed at the partial locking position, the locking claw 553 is brought into a relationship of facing the catching piece 532 on the side of the male housing 520 substantially at the same height position (FIG. 24), however, when the retainer 540 is shifted to a regular locking state, the locking claw 553 rides over the taper face 32*a* of the catching piece 532 to be locked by the upper edge of the locking piece 533 to thereby enable to hold the retainer 540 at the full locking position (FIG. 27). In this full locking position, the catching piece 532 is made to escape into an enlarged recess portion 552.

Further, when the retainer 540 is disposed at the partial locking position, a predetermined gap 554 is held between a front edge of the retainer 540 and a hole edge on a front side of the retainer mounting hole 527 and a state of inserting the male terminal metal piece 510 through the gap 554 (presence or absence of insertion or the like) can be confirmed from outside of the male housing 520. The gap 554 is opened in three directions of the lower direction and the two side directions similar to the retainer mounting hole 527.

Figure 21:
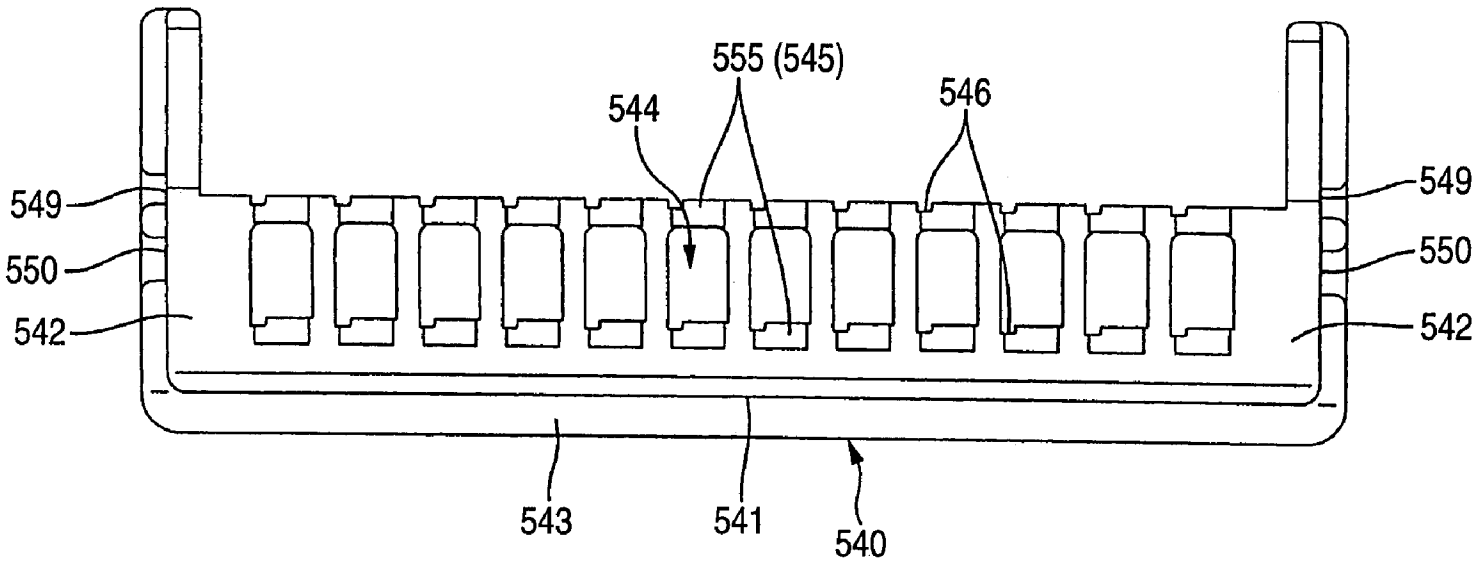
FIG. 21 is a front view of the retainer.

Now, as shown in FIG. 21 through FIG. 23, the pressing projected portions 555 projected to the front side are respectively provided from front faces of the respective drawout preventing portions 545 of the retainer 540. The pressing projected portions 555 are formed to extend the respective drawout preventing portions 545 by a predetermined length to the front side and upper faces thereof are continuously provided with the stabilizer passing grooves 546. A front face 555*a* of the pressing projected portion 555 is formed as a face erected straightly along the up and down direction. A height dimension of the pressing projected portion 555 is set to be substantially the same as a height dimension of the locking stepped portion 516 of the male terminal metal piece 510 (a height dimension of the lower wall 523*a* of the cavity 523, a height dimension of an upper portion of the window frame 544 of the retainer main body portion 541).

Figure 26:
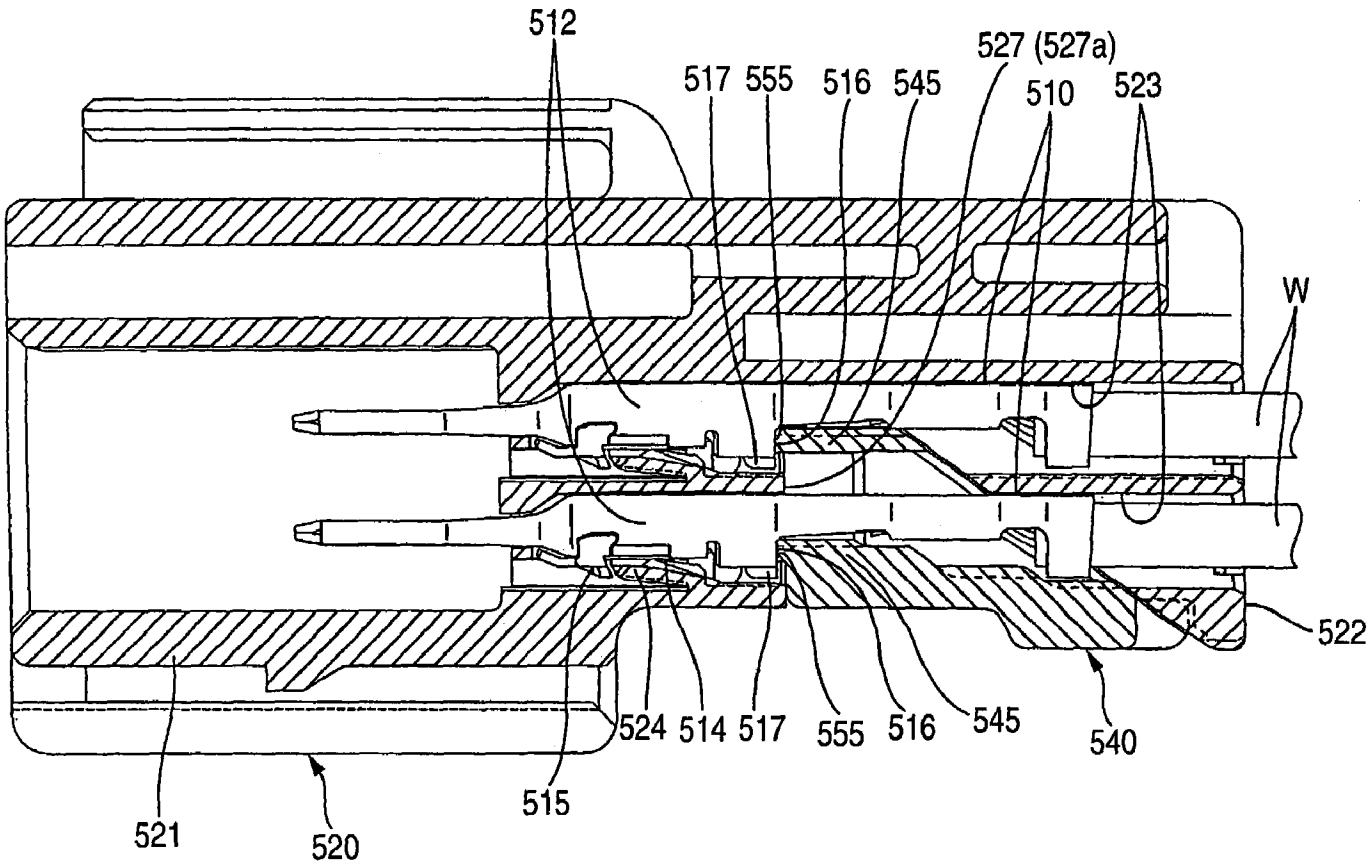
FIG. 26 is a side sectional view showing a state of arranging the retainer at a full locking position.
Figure 28:
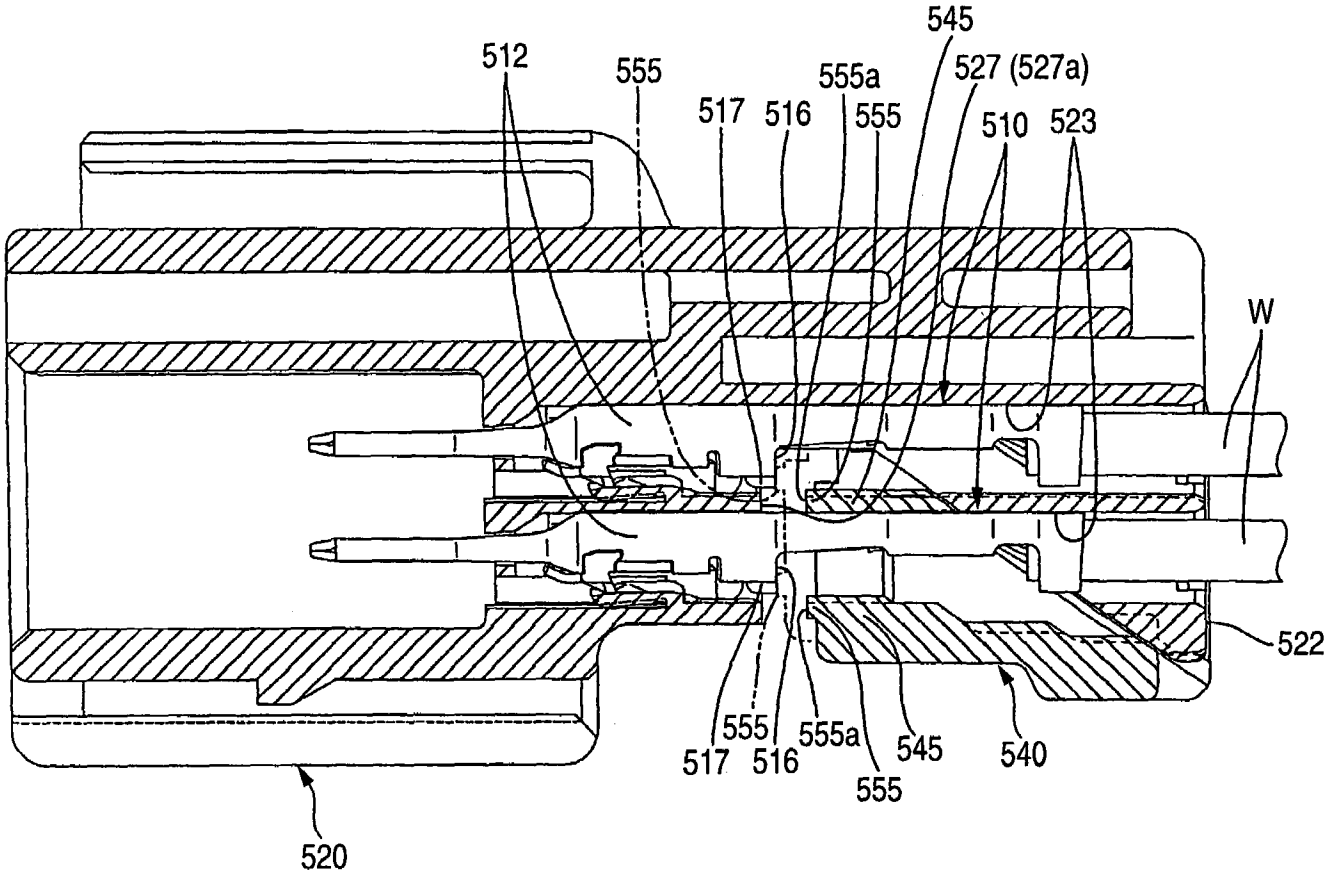
FIG. 28 is a side sectional view showing operation of pressing the retainer in a state of inserting the male terminal metal piece by a half thereof.
Figure 29:
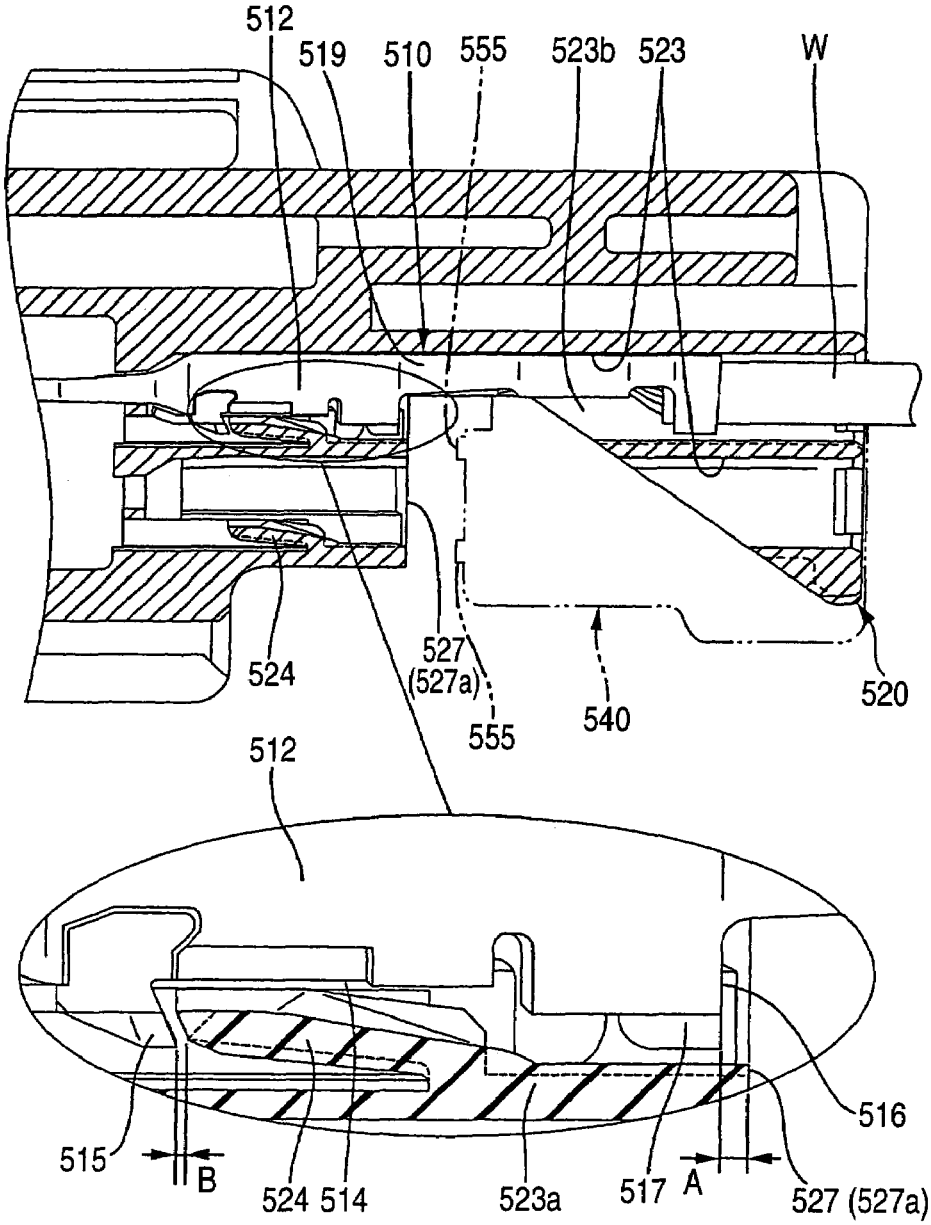
FIG. 29 is a side sectional view showing a state of inserting the male terminal metal piece to a cavity at an upper stage side and detaching the retainer.

The pressing projected portion 555 is arranged at a height position substantially adjusted to the lower wall 523*a* of the cavity 523 and projected from the front edge of the retainer main body 541 to a side of the gap 554 in a state of mounting the retainer 540 at the partial locking position (FIG. 23). Further, when the retainer 540 is moved from the partial locking position to the full locking position, the pressing projected portion 555 is displaced in a skewed upper front direction along a direction of moving the retainer 540 and the front face 555*a* is locked by a rear face of the locking stepped portion 516 of the locking stepped portion 516 (FIG. 26). In the moving procedure, the pressing projected portion 555 is made to advance skewedly into the path of inserting the locking stepped portion 516 and the projected portion 517 of the male terminal metal piece 510. Therefore, when the male terminal metal piece 510 does not reach the regular depth and the locking stepped portion 516 and the projected portion 517 are arranged on a locus of displacing the front face 555*a* of the pressing projected portion 555, in accordance with pressing the retainer 540, the locking stepped portion 516 and the projected portion 517 are pressed to the front side by the front face 555*a* of the pressing projected portion 555 to thereby enable to correct the male terminal metal piece 510 to the regular depth (FIG. 28). At the full locking position, the pressing projected portion 555 is made to advance to the position projected to a front side of the front edge 527*a* of the retainer mounting hole 527 and by pressing the locking stepped portion 516 and the projected portion 517 up to the position, the male terminal metal piece 510 is made to be able to reach the regular depth. At this occasion, the distance A from the front edge 527*a* of the retainer mounting hole 527 to the position of the rear end of the locking stepped portion 516 and the projected portion 517, that is, a dimension of projecting the pressing projected portion 555 is set to be larger than a dimension B of a length of a clearance between a front face of the locking projected portion 515 of the male terminal metal piece 510 constituting the regular depth and the front face of the lance 524 (FIG. 29).

The second embodiment is constituted by the above-described structure and operation thereof will successively be explained. First, a method of molding the male housing 520 and the retainer 540 will be explained. Generally, the male housing 520 and the retainer 540 are molded by a resin at inside of the same molding die and the retainer 540 is integrated to the male housing 520 at the partial locking position at inside of the die.

Figure 31A:
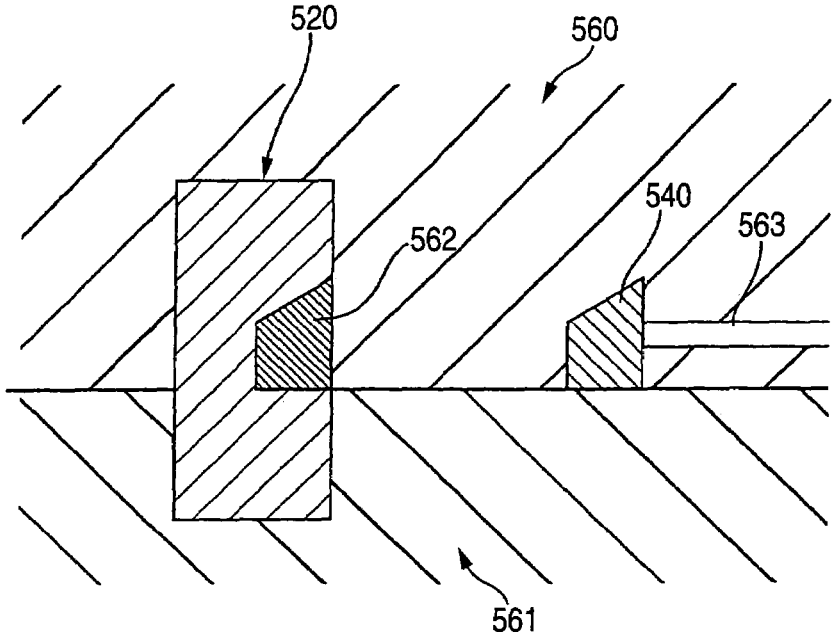
FIGS. 31A and 31B illustrate sectional views showing an outline of a situation of molding the male housing and the retainer.
Figure 31B:
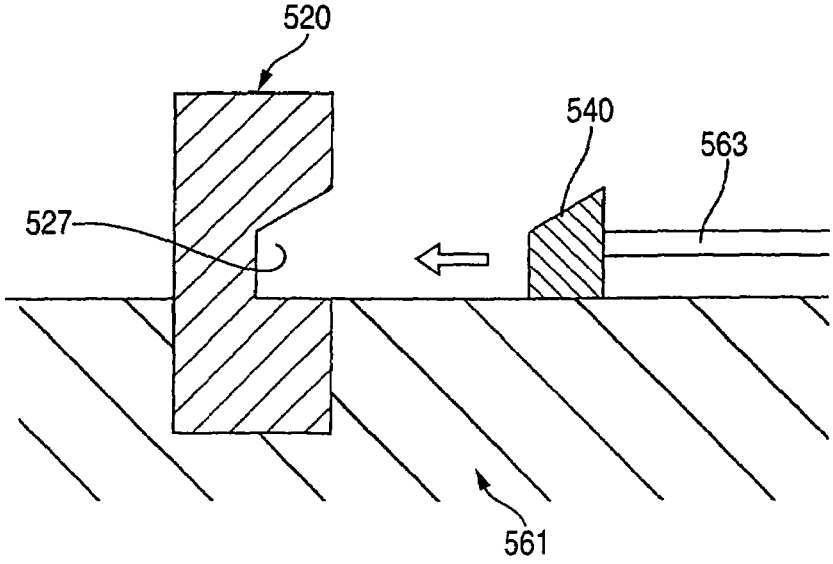

In details, as shown in FIGS. 31A and 31B, a total of the male housing 520 is molded by a pair of dies 560, 61 opened and closed along a direction of a length of the cavity 523 (up and down direction of the illustration, front and rear direction), and the retainer mounting hole 527 is molded by a sliding die 562 moved forward and rearward along a direction orthogonal to the above-described direction and also orthogonal to the direction of mounting the retainer 540 (direction orthogonal to paper face of the drawing), that is, the sliding die 562 moving into and back from the side of the male housing 520. Further, also the retainer 540 is molded at a position on the right side of the illustration of the portion of molding the retainer mounting hole in dies the same as the dies 560, 561 for molding the male housing 520. Further, after opening the dies, when the retainer 540 is pushed to the retainer mounting hole 527 by a pushing pin 563, the retainer 540 can be mounted to the partial locking position. That is, the inner-die integrating (inner-die assembly) is carried out.

Figure 25:
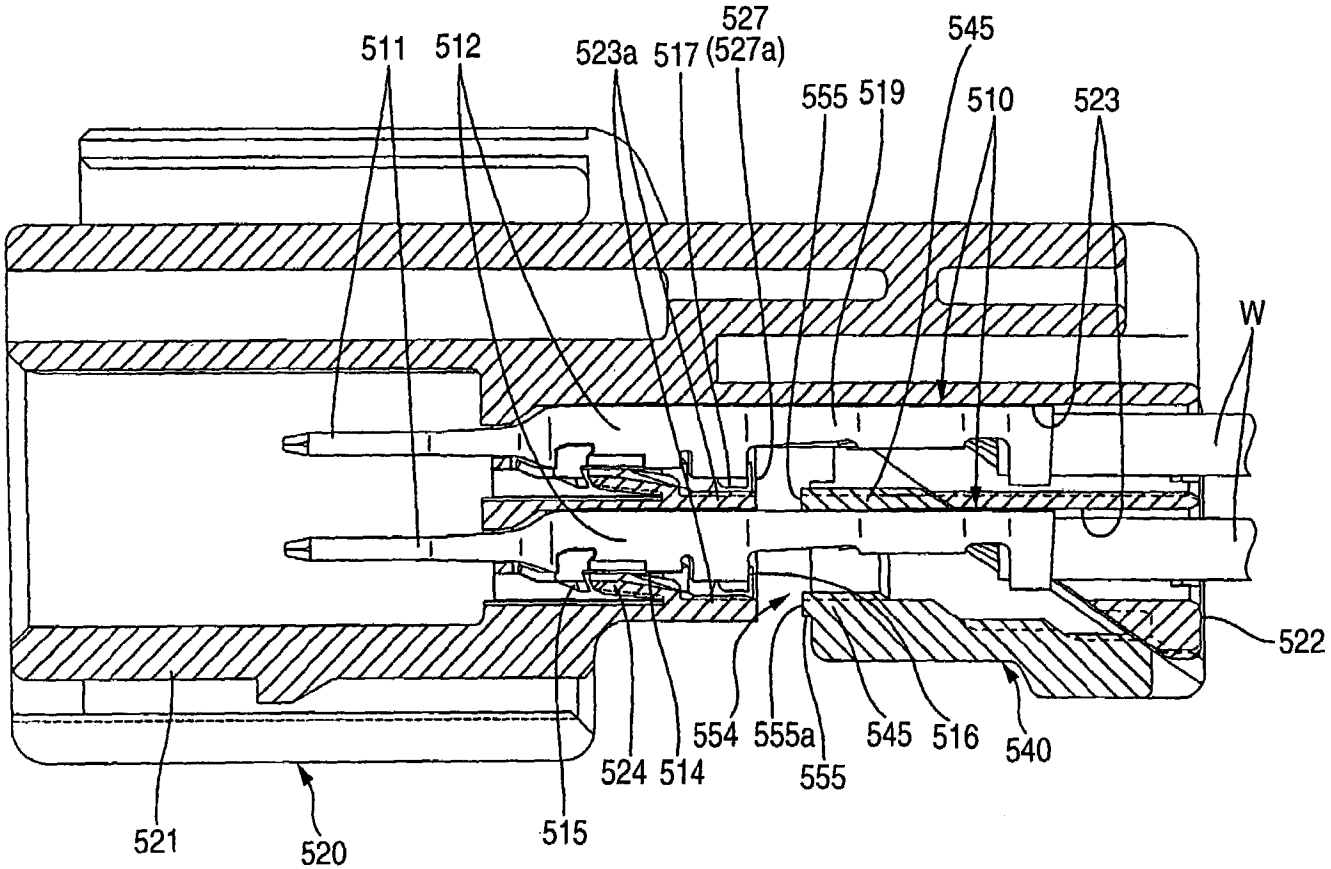
FIG. 25 is a side sectional view showing a state of inserting the male terminal metal piece to a regular depth.

When the retainer 540 is mounted to the male housing 520 at the partial locking position in this way, as shown in FIG. 23, the male terminal metal pieces 510 are inserted from the rear side into the respective cavities 523. Then, operation of inserting the male terminal metal piece 510 is smoothly guided by inserting the locking projected portion 515, the stabilizer 518 and the projected portion 517 into the projected portion inserting groove 525, the stabilizer inserting groove 526 and the stabilizer passing groove 546 successively in correspondence therewith. When the male terminal metal piece 510 is inserted to a predetermined depth, the lance 524 is pressed by the locking projected portion 515 to temporarily be deformed to bend to the lower side. Further, when the male terminal metal piece 510 reaches a regular depth, as shown in FIG. 25, the locking projected portion 515 rides over the lance 524, the lance 524 is elastically recovered to advance into the recess portion 5514 to be locked by a front edge of the recess portion 5514 and a rear end face of the locking projected portion 515. In the state in which the male terminal metal piece 510 is inserted to the regular depth in this way, a clearance for permitting to recover the lance 524 is formed between the front face of the lance 524 and the front edge of the recess portion 5514 and the rear face of the locking projection 515, further, the locking stepped portion 516 and the projected portion 517 are arranged to be separated from the front edge 527*a* of the retainer mounting hole 527 to the front side by the predetermined distance A.

When all of the male terminal metal pieces 510 have been finished to insert, operation of moving the retainer 540 from the partial locking position to the full locking position is carried out. When the retainer 540 is pressed to the skewed upper front direction, a periphery of the lower end portion of the guide groove 549 is deformed to make the restricting projection 530 ride thereover to move out from the guide groove 549 and is pressed to the skewed upper direction by being operated to be guided by fitting together the locking projection 529 and the guide groove 549. Further, when the retainer 540 reaches the full locking position, as shown in FIG. 26, the pressing projected portion 555 of each drawout preventing portion 545 advances into each cavity 523 and is locked by the rear end face of the locking stepped portion 516 of the corresponding male terminal metal piece 510 to thereby hold the male terminal metal piece 510 in the drawout preventing state at the regular inserting depth.

At the full locking position, as shown in FIG. 27, the locking projection 529 is locked by the lower end of the guide groove 549 and the press restricting projection 530 is locked by the rear edge of the side plate 542. Further, at this occasion, the locking claw 553 rides over the taper face 531*a* of the holding portion 532 to be locked by the upper edge of the holding portion 532, in addition thereto, the locking portion 48 advances into the locking recess portion 533 and a rear face thereof is locked by a front face of the locking recess portion 533 to thereby doubly hold the retainer 540 at the main locking position. Further, by locking the lower edge of the jouncing restricting portion 531 by the lower edge of the restricting recess portion 561, jouncing of the retainer 540 to the upper side is also restricted. Further, at the full locking position, the front edge of the retainer main body portion 541 is substantially brought into contact with the front edge of the retainer mounting hole 527, an interval between the two members are substantially closed without a gap therebetween and therefore, dust or dirt or the like can be prevented from penetrating inside of the cavity 523. When the male connector has been finished to integrate as described above, a counter female connector, not illustrated, is connected to fit into the hood portion 521.

Meanwhile, in a procedure of integrating the male connector, when the male terminal metal piece 510 is inserted into the cavity 523, there is a case in which the male terminal metal piece 510 is retained at a position before reaching the regular depth to thereby bring about so-called half inserted state. At this occasion, as shown in FIG. 28, when the male terminal metal piece 510 is inserted to a depth of arranging the locking stepped portion 516 and the rear face of the projected portion 517 on a locus of displacing the front face 555*a* of the pressing projected portion 555, in the case in which the retainer 540 is pressed to the skewed upper front direction from the partial locking position, as shown in an imaginary line of the drawing, the front face 555*a* of the pressing projected portion 555 is brought into contact with the locking stepped portion 516 and the rear face of the projected portion 517. In accordance with further pressing the retainer 540 from the state, the locking stepped portion 516 and the projected portion 517 can be pressed to the front side by the pressing projected portion 555 displacing in the skewed upper front direction. Further, when the retainer 540 reaches the full locking position, the locking stepped portion 516 and the projected portion 517 can be pressed to a position projected frontward from the front edge 527*a* of the retainer mounting hole 527 by the pressing projected portion 555 to thereby enable to correct the male terminal metal piece 510 to the regular depth. In the procedure, the lance 524 advances into the recess portion 5514 and is locked by a front edge thereof and the locking projected portion 525. Further, in the case in which the depth of inserting the male terminal metal piece 510 is more deficient than that in the above-described half inserted state and the locking stepped portion 516 and the projected portion 517 are arranged rearward from the locus of displacing the front face 555*a* of the pressing projected portion 555, by bringing the upper face of the drawout preventing portion 545 including the pressing projected portion 555 into contact with the lower face of the projected portion 517, operation of pressing the retainer 540 is restricted and therefore, thereby, deficiency of the male terminal metal piece 510 is made to be able to detect.

Meanwhile, although the male connector is used to be mounted to an automobile or the like, depending on a difference in a vehicle kind or a grade there is a case in which the cavity 523 which is not used is brought about, for example, there is a case in which the male terminal metal piece 510 is not inserted into the cavity 523 at the lower stage side at all. In such a case, despite the state of finishing integration (for example, a state fitted to the counter female connector), there is a possibility of moving the retainer 540 to a side of the partial locking position, unpreparedly by some situation (refer to an imaginary line of FIG. 29), depending on cases, as shown in FIG. 29, the retainer 540 is detached from the male housing 520. Under the state, the region of the path for inserting the locking stepped portion 516 and the projected portion 517 rearward from the front edge 527*a* of the retainer inserting hole 527 is opened in three directions of the lower direction and the two side direction. Further, when a force of pulling the electric wire W is operated under the state, the male terminal metal piece 510 inserted into the cavity 523 at the upper stage is moved back within the range of the clearance formed between the front face of the lance 524 and the rear face of the locking projected portion 515.

Figure 30:
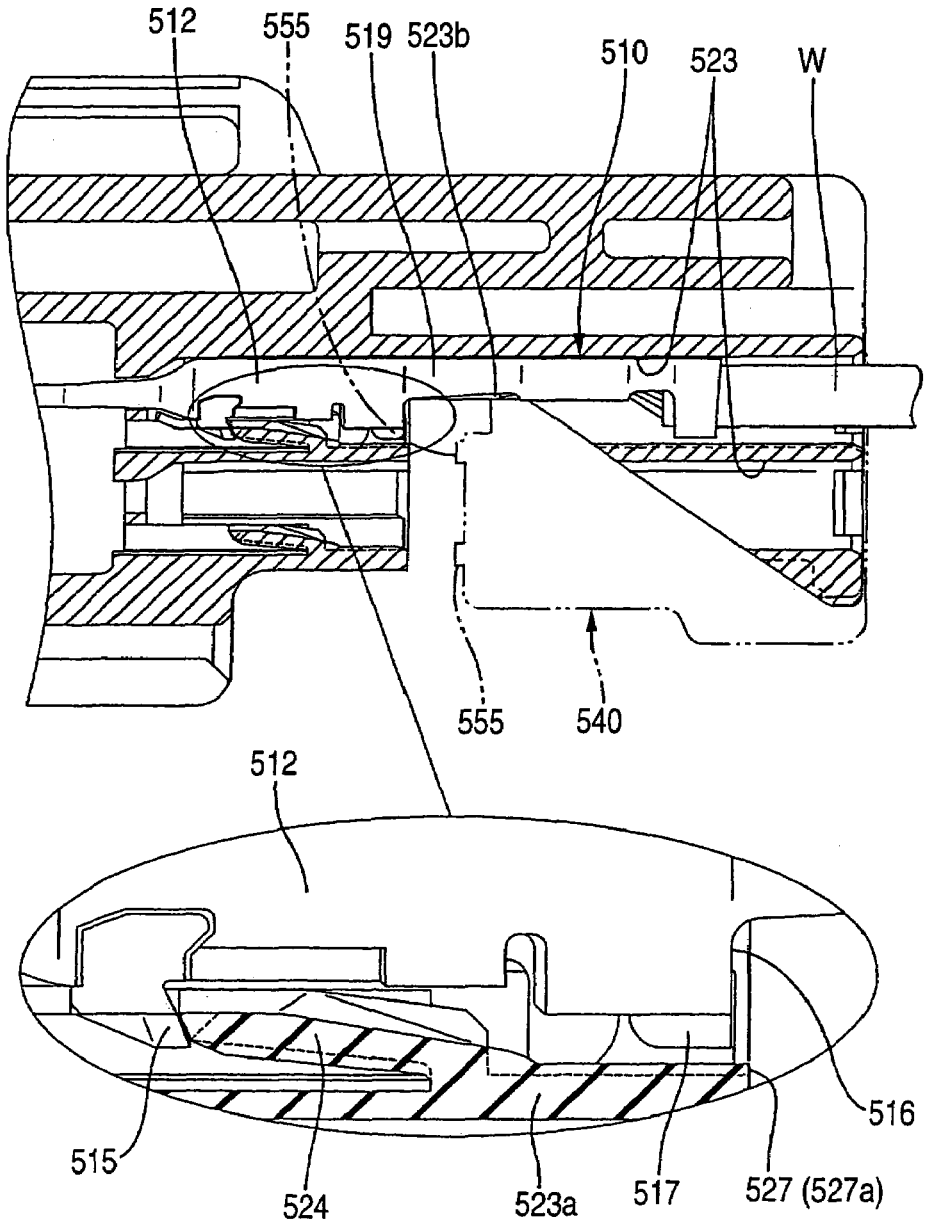
FIG. 30 is a side sectional view showing a state of pulling the male terminal metal piece to move back.

Even in such a case, the locking stepped portion 516 and the projected portion 517 are arranged frontward from the front edge 527*a* of the retainer inserting hole 527 by the distance A (dimension of projecting the pressing projected portion 555) larger than a length dimension B of the above-described clearance and therefore, as shown in FIG. 30, even in a state of maximally moving back the male terminal metal piece 510, the locking stepped portion 516 and the projected portion 517 are arranged frontward from the front edge 527*a* of the retainer mounting hole 527 and is firmly avoided from reaching a region on the rear side of the front edge 527*a* of the retainer mountain hole 527. Therefore, for example, even when a foreign object of a slender tool or the like invades inside of the retainer mounting hole 527 on the width direction to reach the path of inserting the locking stepped portion 516 and the projected portion 517, the foreign object is prevented from being brought into contact with the locking stepped portion 516 and the projected portion 517. Thereby, a situation of short-circuiting the male terminal metal pieces 510 aligned in the width direction can be prevented. Further, when the male terminal metal piece 510 is maximally moved back, by catching the lance 524 by the front edge of the recess portion 5514 and the locking projected portion 515, the male terminal metal piece 510 is restricted from moving back further. Further, the connecting portion 519 of the male terminal metal piece 510 is protected by the side wall 523*b* of the cavity 523 and therefore, the invaded foreign object is prevented from being brought into contact therewith.

As has been explained above, according to the second embodiment, the drawout preventing portion 545 is provided with the pressing projected portion 555, the locking stepped portion 516 and the projected portion 517 provided at the rear end of the main body portion 512 are pressed to the position projected frontward from the front edge 527*a* of the retainer mounting hole 527 by the pressing projected portion 555 and therefore, even when the male terminal metal piece 510 is pulled to the rear side and the male terminal metal piece 510 is moved back in the range of the clearance between the male terminal metal piece 510 and the lance 524 in a state in which the retainer 540 is moved from the full locking position to the partial locking position, or the retainer 540 is detached from the male housing 520, the locking stepped portion 516 and the projected portion 517 are avoided from reaching the region rearward from the front edge 527*a* of the retainer mounting hole 527. Therefore, even when an outside foreign object invades the retainer mounting hole 527 to reach the path of inserting the locking stepped portion 516 and the projected portion 517, the outside foreign object is prevented from being brought into contact with the locking stepped portion 516 and the projected portion 517 to thereby enable to prevent a situation of shortcircuiting the male terminal metal pieces 510 aligned in the width direction.

Further, the retainer mounting hole 527 shown in the second embodiment is formed to open in three directions of the direction of mounting the retainer 540 and the directions orthogonal to the mounting direction with a main object of subjecting the retainer 540 to the inner-die assembly relative to the male housing 520 and formed to the depth of opening the inserting path in the three directions for convenience of moving the drawout preventing portion 545 to the path of inserting the locking stepped portion 516 and the projected portion 517.

The invention is not limited to the second embodiment explained by the above-described description and the drawings but, for example, the following embodiments are included in the technical range of the invention, further, the invention can be embodied by being variously changed within the range not deviated from the gist other than described below.

A shape and a position of arranging the pressing projected portion can arbitrarily be set other than the second embodiment.

Although the second embodiment exemplifies the connector having the two upper and lower stages of cavities, the invention is applicable also to a connector of one stage thereof or three or more stages in an up and down direction. Further, in the case of the connector having one stage of cavities, the terminal metal piece can be prevented from being drawn out by inserting the terminal metal piece into the cavity in a state in which the retainer is not mounted to the housing and thereafter mounting the retainer to the housing at the full mounting position. Further, the partial locking position of the retainer may be omitted.

Although the second embodiment exemplifies the connector on the male side, the invention is applicable to a connector on a female side containing a female terminal metal piece.

Although the second embodiment exemplifies the case of carrying out so-called inner-die assembly in fabricating steps, there may be carried out so-called separate assigning in which, for example, the housing and the retainer are molded by a resin respectively by separate molding dies and after the dies are opened, the operator integrates the retainer to the housing at the partial locking position. In sum, by constituting the retainer mounting hole by the mode of opening in three directions, in the fabricating steps, the inner-die assembly and the separate assigning can selectively adopted, which is convenient.

As described above with reference to the first and the second embodiments, in a state of arranging the retainer at the tacked locking position, the gap is opened between the front edge of the retainer and the front edge of the retainer mounting hole. At this occasion, by arranging the restricting portion to project to the side of the gap, the outside foreign object can be restricted from penetrating the cavity.

Although according to the constitution of opening the retainer mounting hole in the three directions, when the foreign object of an electric wire or the like assumedly invades the gap, the foreign object is liable to interfere with the male terminal metal piece, by previously restricting the foreign object from penetrating by the restricting portion, such a situation can be prevented.

In the state of mounting the retainer to the full locking position, by arranging the catch preventing portion proximately to the restricting portion, the outside electric wire or the like can be prevented from being caught by the restricting portion, thereby, the retainer can be prevented from being positionally shifted to a side of the partial locking position.

The portions of the gap in correspondence with the terminal metal pieces in the respective cavities having the different heights are arranged to positionally shift in the front and rear direction by the projected portion and the recess portion and therefore, a situation of bringing an outside foreign object simultaneously into contact with the terminal metal pieces in the respective cavities having the different heights is difficult to be brought about and therefore, the terminal metal pieces can be prevented from being short-circuited to each other.

When the terminal metal piece is inserted into at least any one of the respective cavities, the retainer can be locked by the terminal metal piece and therefore, a situation of detaching the retainer from the partial locking position can be prevented.

When the retainer is mounted to the regular mounting position in the state in which the terminal metal piece inserted into the cavity does not reach the regular depth, by moving the retainer skewedly to the direction of inserting and drawing the terminal metal piece, the terminal metal piece can be corrected to the regular depth by pressing the rear end of the main body portion to the front side by the drawout preventing portion. In the procedure, the rear end of the main body portion is pressed to the position projected frontward from the front edge of the retainer mounting hole by the pressing projected portion of the drawout preventing portion. When the terminal metal piece reaches the regular depth, by locking the lance, drawout is prevented doubly.

Meanwhile, when the retainer is returned from the regular mounting position to a position before the mounting direction, or the retainer is detached from the connector housing, in the path of inserting the rear end of the main body portion, a region rearward from the front edge of the retainer mounting hole is opened in the three directions. When the terminal metal piece is pulled under the state, the terminal metal piece can be moved back within the range of the clearance formed between the terminal metal piece and the lance. Even in this case, the rear end of the main body portion is pressed frontward from the front edge of the retainer mounting hole by the pressing projected portion and therefore, even when the terminal metal piece is more or less moved back, the rear end of the main body portion is avoided from reaching rearward from the front edge of the retainer mounting hole. Therefore, even when an outside foreign object invades the retainer mounting hole to reach the inserting path at the rear end of the main body portion, the outside foreign object is prevented from being brought into contact with the rear end of the main body portion to thereby enable to prevent a situation of shortcircuiting the terminal metal piece with other terminal metal piece.

Although the present invention has been shown and described with reference to specific embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A connector comprising:

a connector housing;

a cavity provided in the connector housing and capable of inserting a terminal metal piece from a rear side; and a retainer mounting hole formed on the connector housing and opens the cavity to an outer side;

a retainer mounted movably to the retainer mounting hole for movement in a moving direction that is skewed to a direction of inserting and withdrawing the terminal metal piece between a partial locking position permitting insertion and withdrawal of the terminal metal piece and a full locking position for locking the terminal metal piece and a gap is opened between a front edge of the retainer and a front edge of the retainer mounting hole at the partial locking position; and wherein at least either one of the retainer and the connector housing is provided with a restricting portion projecting in a direction skewed to the moving direction of the retainer and on a side of the gap, the restricting portion projecting sufficiently to restrict a foreign object from penetrating through the gap and into the cavity when the retainer is at the partial locking position.

2. The connector according to claim 1, wherein the retainer mounting hole is notched and open in three directions from a face opposed to a direction of pressing the retainer to a pair of side faces continuous thereto in the connector housing.

3. The connector according to claim 1, wherein the restricting portion is formed to project from the retainer to a front side, and wherein the connector housing is provided with a catch preventing portion arranged to be proximate to the restricting portion in a state of mounting the retainer to the full locking position.

4. A connector comprising:

a connector housing;

a plurality of cavities provided in the connector housing to be aligned in a height direction and capable of inserting terminal metal pieces from a rear side; and a retainer mounting hole formed on the connector housing and opens the respective cavities to outer sides the retainer mounting hole capable of mounting a retainer which is notched to form to open in three directions along a face opposed to a direction of pressing the retainer over to a pair of side faces along the height direction contiguous thereto, wherein the retainer is mounted movably and skewedly to a direction of inserting and drawing the terminal metal pieces between a partial locking position permitting to insert and draw the terminal metal pieces and a full locking position locked to the terminal metal pieces, and at the partial locking position, a gap is opened between a front edge of the retainer and a front edge of the retainer mounting hole; and wherein whereas a projected portion projected to a side of the gap is provided at at least either one of the retainer and the connector housing, a recess portion for escaping the projected portion when a retainer is moved to the full locking position is formed at an opposed side thereof to thereby arrange portions of the gap in correspondence with the terminal metal pieces in the respective cavities having different heights to be positionally shifted from each other in a front and rear direction.

5. The connector according to claim 4, wherein the retainer is formed substantially in a shape of a lattice to permit to insert and draw the terminal metal pieces by being communicated with the respective cavities in a state of being mounted to the partial locking position and locked by the terminal metal pieces inserted into the respective cavities to thereby enable to restrict the retainer from being detached.

6. A connector comprising:

a connector housing;

a cavity provided in the connector housing and capable of inserting from a rear side a terminal metal piece having a main body portion having substantially a box-like shape; and a retainer mounting hole formed on the connector housing and opens the cavity to an outer side and capable of mounting a retainer, wherein whereas inside of the cavity is provided with a lance capable of being locked by the terminal metal piece inserted to a full depth, the retainer is provided with a drawout preventing portion locked by a rear end of the main body portion when the retainer is mounted to a full mounting position and is made to be movable skewedly to a direction of inserting and drawing the terminal metal piece when the retainer reaches the full mounting position to thereby enable to press the rear end of the main body portion of the terminal metal piece which is deficient in a depth of being inserted into the cavity by the drawout preventing portion to correct to a full depth, wherein the retainer mounting hole is notched to form open in three directions from a face thereof opposed to a direction of mounting the retainer in the connector housing over to a pair of faces thereof contiguous thereto and along the direction of mounting the retainer and formed to a depth of opening an inserting path at a rear end of the main body portion to the three direction, and wherein the drawout preventing portion is provided with a pressing projected portion capable of pressing the rear end of the main body portion to a position projected frontward from a front edge of the retainer mounting hole in the cavity by moving to the position when the retainer is mounted to the full mounting position.

* * * * *

UNITED STATES PATENT AND TRADEMARK OFFICE

CERTIFICATE OF CORRECTION

PATENT NO. : 7,056,159 B2
APPLICATION NO. : 10/866208
DATED : June 6, 2006
INVENTOR(S) : Yukihiro Fukatsu It is certified that error appears in the above-identified patent and that said Letters Patent is hereby corrected as shown below:

On the Title page correct field (30) to read:
(30) Foreign Application Priority Data Jun. 11, 2003 (JP) .....2003-166788
Jun. 11, 2003 (JP) .....2003-166915
Jun. 11, 2003 (JP) .....2003-166995

Signed and Sealed this

Fifth Day of September, 2006

JON W. DUDAS
*Director of the United States Patent and Trademark Office*